US010442610B2

(12) United States Patent
Mack et al.

(10) Patent No.: US 10,442,610 B2
(45) Date of Patent: Oct. 15, 2019

(54) POD-BASED RESTRICTORS AND METHODS

(71) Applicant: Starbucks Corporation, Seattle, WA (US)

(72) Inventors: Adam Mekeel Mack, Menlo Park, CA (US); Philipe Roget Manoux, Oakland, CA (US)

(73) Assignee: Starbucks Corporation, Seattle, WA (US)

( * ) Notice: Subject to any disclaimer, the term of this patent is extended or adjusted under 35 U.S.C. 154(b) by 510 days.

(21) Appl. No.: 14/205,197

(22) Filed: Mar. 11, 2014

(65) Prior Publication Data

US 2015/0259134 A1 Sep. 17, 2015

(51) Int. Cl.
*B65D 85/804* (2006.01)
*B65D 65/46* (2006.01)

(52) U.S. Cl.
CPC ..... *B65D 85/8043* (2013.01); *B65D 65/466* (2013.01)

(58) Field of Classification Search
CPC ..... B65D 85/8043; B65D 65/466
See application file for complete search history.

(56) References Cited

U.S. PATENT DOCUMENTS

| | | | |
|---|---|---|---|
| 1,345,477 | A | 7/1920 | Capelli |
| 2,019,056 | A | 10/1935 | Osgood et al. |
| 2,288,240 | A | 6/1942 | Herman |
| 2,529,395 | A | 11/1950 | Hummel |
| 2,561,134 | A | 7/1951 | Peters |
| 2,667,827 | A | 2/1954 | Peters |
| 2,728,678 | A | 12/1955 | Sharp |
| 3,229,612 | A | 1/1966 | Brown |
| 3,332,337 | A | 7/1967 | Lowry |
| 3,370,523 | A | 2/1968 | Wright |
| 3,373,043 | A | 3/1968 | Rubinstein |
| 3,374,727 | A | 3/1968 | Wright |
| 3,388,804 | A | 6/1968 | Hester |
| 3,446,624 | A | 5/1969 | Luedtke |
| 3,652,293 | A | 3/1972 | Lombana et al. |
| 3,769,032 | A | 10/1973 | Lubsen et al. |
| 3,771,431 | A | 11/1973 | Ehrenberg, Jr. |
| 3,796,032 | A | 3/1974 | Clontz |

(Continued)

FOREIGN PATENT DOCUMENTS

| | | |
|---|---|---|
| CA | 2119178 A1 | 9/1994 |
| CA | 2330615 A1 | 9/2000 |

(Continued)

OTHER PUBLICATIONS

Ahlstrom Corporation, "CD50122M Provisional Datasheet," 2011, in 1 page.

(Continued)

*Primary Examiner* — Viren A Thakur
*Assistant Examiner* — Thanh H Nguyen
(74) *Attorney, Agent, or Firm* — Knobbe Martens Olson & Bear, LLP

(57) ABSTRACT

A single-serve beverage cartridge including a generally hollow body portion having a chamber, a sidewall, a first end, and a second end. A beverage component or precursor can be positioned in the chamber. Further, the second end can include at least one restricting orifice that can facilitate the creation of a predetermined amount of pressure in the chamber.

19 Claims, 9 Drawing Sheets

(56) References Cited

U.S. PATENT DOCUMENTS 3,796,222 A 3/1974 Deszyck
3,812,773 A 5/1974 Hultsch
3,929,141 A 12/1975 Beringer et al.
3,934,594 A 1/1976 Beringer et al.
3,985,069 A * 10/1976 Cavalluzzi ..... A47J 31/02 426/77
4,007,674 A 2/1977 Lichowsky
4,136,202 A 1/1979 Cook et al.
4,158,329 A 6/1979 McKnight
4,196,658 A 4/1980 Takagi et al.
4,226,175 A 10/1980 Sandor
4,353,293 A 10/1982 Illy
4,471,689 A 9/1984 Voegele et al.
4,510,853 A 4/1985 Takagi
4,550,024 A 10/1985 Bostwick
4,555,894 A 12/1985 Illy
4,572,719 A 2/1986 Theobald
4,626,435 A 12/1986 Zimmerman
4,801,464 A 1/1989 Hubbard, Jr.
4,852,333 A 8/1989 Illy
4,853,234 A 8/1989 Tidwell et al.
4,860,645 A 8/1989 van der Lijn et al.
4,867,993 A 9/1989 Nordskog
4,948,018 A 8/1990 Donofrio et al.
4,995,310 A 2/1991 Carusillo et al.
4,996,066 A 2/1991 Love et al.
5,008,013 A 4/1991 Donofrio
D320,529 S 10/1991 Brugger
D320,530 S 10/1991 Nicholas et al.
5,082,676 A 1/1992 Love et al.
5,083,502 A 1/1992 Enomoto
5,180,114 A 1/1993 Chen
5,211,344 A 5/1993 In Albon
5,243,164 A * 9/1993 Erickson ..... A47J 31/02 219/689
5,325,765 A 7/1994 Riedel et al.
5,472,719 A 12/1995 Favre
5,555,790 A 9/1996 Ackermann
5,568,763 A 10/1996 Kunzler
5,571,441 A 11/1996 Andon et al.
5,573,841 A 11/1996 Adam et al.
5,637,335 A 6/1997 Ritchart et al.
5,638,741 A 6/1997 Cisaria
5,656,311 A 8/1997 Fond
5,773,067 A 6/1998 Bassereau
5,836,326 A 11/1998 Inkster
5,840,189 A 11/1998 Sylvan et al.
5,866,185 A 2/1999 Burkett
5,897,899 A 4/1999 Fond
5,948,455 A 9/1999 Schaeffer et al.
6,076,454 A 6/2000 Hagon
6,164,191 A 12/2000 Liu et al.
D452,433 S 12/2001 Fox et al.
D452,434 S 12/2001 Lim
6,327,965 B1 * 12/2001 Lin Tien ..... A47J 31/02 99/299
6,378,244 B1 4/2002 Iwata et al.
6,510,783 B1 1/2003 Basile et al.
6,537,543 B1 3/2003 Minakawa
D474,110 S 5/2003 Lim
D474,111 S 5/2003 Trott
6,589,577 B2 7/2003 Lazaris
6,607,762 B2 8/2003 Lazaris et al.
6,645,537 B2 11/2003 Sweeney et al.
6,658,989 B2 12/2003 Sweeney et al.
6,698,333 B2 3/2004 Halliday et al.
6,716,462 B2 4/2004 Prosise et al.
6,720,015 B2 4/2004 Prosise et al.
6,726,943 B2 4/2004 Prosise et al.
6,740,345 B2 5/2004 Cai
6,777,007 B2 8/2004 Cai
6,827,954 B2 12/2004 Prosise et al.
6,846,501 B2 1/2005 Prosise et al.
6,849,285 B2 2/2005 Masek et al.
D502,362 S 3/2005 Trott
6,869,627 B2 3/2005 Perkovic et al.
6,899,905 B2 5/2005 Prosise et al.
D506,926 S 7/2005 Tal et al.
6,948,420 B2 9/2005 Green et al.
D513,152 S 12/2005 Sjostrom et al.
7,028,604 B2 4/2006 Cortese
7,033,623 B2 4/2006 Suzuki et al.
7,069,837 B2 7/2006 Sachtleben
D530,626 S 10/2006 Mueller et al.
7,150,880 B2 12/2006 Howard et al.
D539,643 S 4/2007 Ventura
7,213,506 B2 5/2007 Halliday et al.
7,219,598 B2 5/2007 Halliday et al.
7,226,628 B2 6/2007 Cai
7,235,764 B2 6/2007 Poss
7,243,598 B2 7/2007 Halliday et al.
7,287,461 B2 10/2007 Halliday et al.
7,308,851 B2 12/2007 Halliday
7,322,277 B2 1/2008 Halliday et al.
7,328,651 B2 2/2008 Halliday et al.
7,377,089 B2 5/2008 Rapparini
7,412,921 B2 8/2008 Hu et al.
7,418,899 B2 9/2008 Halliday et al.
7,340,990 B2 11/2008 Halliday et al.
7,469,628 B2 12/2008 Mandralis et al.
7,510,649 B1 3/2009 Lavigne
7,533,603 B2 5/2009 Halliday et al.
7,533,604 B2 5/2009 Halliday et al.
7,543,527 B2 6/2009 Schmed
7,552,672 B2 6/2009 Schmed
7,569,243 B2 8/2009 Yoakim et al.
7,578,419 B2 8/2009 Greenwald et al.
7,592,027 B2 9/2009 Halliday et al.
7,594,470 B2 9/2009 Cox, Jr. et al.
7,604,826 B2 10/2009 Denisart et al.
7,610,849 B2 11/2009 Bigge et al.
7,624,673 B2 12/2009 Zanetti
7,640,843 B2 1/2010 Halliday et al.
7,651,015 B2 1/2010 Girard et al.
7,658,141 B2 2/2010 Masek et al.
7,673,558 B2 3/2010 Panesar et al.
7,681,492 B2 3/2010 Suggi Liverani et al.
7,685,931 B2 3/2010 Rivera
7,703,383 B2 4/2010 Knitel
7,717,027 B2 5/2010 Sato et al.
7,770,512 B2 8/2010 Albrecht
7,790,211 B2 9/2010 Eijsackers et al.
7,798,054 B2 9/2010 Evers et al.
D624,785 S 10/2010 Deng
7,815,953 B2 10/2010 Mastropasqua et al.
7,828,020 B2 11/2010 Girard et al.
7,832,328 B2 11/2010 Koeling et al.
7,836,819 B2 11/2010 Suggi Liverani et al.
7,878,108 B2 2/2011 Mock et al.
7,891,286 B2 2/2011 Cox, Jr. et al.
7,896,202 B2 3/2011 Greenwald et al.
7,921,766 B2 4/2011 Halliday et al.
7,926,415 B2 4/2011 Yoakim et al.
D637,484 S 5/2011 Saadat
7,946,217 B2 5/2011 Favre et al.
7,947,316 B2 5/2011 Kirschner et al.
7,964,230 B2 6/2011 Bennett et al.
7,981,451 B2 7/2011 Ozanne
8,012,523 B2 9/2011 Voss et al.
8,028,867 B2 10/2011 Sterngold et al.
8,033,211 B2 10/2011 Halliday et al.
8,039,029 B2 10/2011 Ozanne
8,039,036 B2 10/2011 Knitel et al.
8,043,645 B2 10/2011 Robinson et al.
8,069,775 B2 12/2011 Russo
8,088,423 B2 1/2012 Ohresser et al.
8,109,200 B2 2/2012 Hansen
8,114,457 B2 2/2012 Robinson et al.
8,114,458 B2 2/2012 Robinson et al.
8,114,459 B2 2/2012 Robinson et al.
8,147,886 B2 4/2012 Knitel et al.
8,147,887 B2 4/2012 Dogan et al.
8,161,868 B2 4/2012 Bolzicco et al.
8,163,318 B2 4/2012 Bourdeau et al.

(56) References Cited

U.S. PATENT DOCUMENTS 8,168,247 B2 5/2012 Halliday et al.
8,186,264 B2 5/2012 Rijskamp et al.
8,210,396 B2 7/2012 Girard et al.
8,225,710 B2 7/2012 De Graaff et al.
8,225,712 B2 7/2012 Bunke et al.
8,230,775 B2 7/2012 Vanni
8,231,918 B2 7/2012 Ohresser et al.
8,257,766 B2 9/2012 Yoakim et al.
8,263,148 B2 9/2012 Yoakim et al.
8,322,271 B2 9/2012 Glucksman et al.
8,307,754 B2 11/2012 Ternite et al.
8,312,806 B2 11/2012 De Graaff et al.
8,327,754 B2 12/2012 Kirschner et al.
8,361,527 B2 1/2013 Winkler et al.
8,414,953 B2 4/2013 Robinson et al.
8,425,957 B2 4/2013 Steenhof et al.
8,443,717 B2 5/2013 Venturi
8,464,630 B2 6/2013 Suggi Liverani et al.
8,464,631 B2 6/2013 Suggi Liverani et al.
8,464,632 B2 6/2013 Suggi Liverani et al.
8,524,306 B2 9/2013 Robinson et al.
8,535,743 B2 9/2013 Kamerbeek et al.
8,535,748 B2 9/2013 Robinson et al.
8,541,042 B2 9/2013 Robinson et al.
8,563,058 B2 10/2013 Roulin et al.
8,617,627 B2 12/2013 Steenhof et al.
RE44,759 E 2/2014 Steenhof et al.
8,656,827 B2 2/2014 Vanni
8,661,967 B2 3/2014 Gonen
8,752,478 B2 6/2014 Nocera
8,758,844 B2 6/2014 Nocera
8,759,727 B2 6/2014 Gard et al.
8,776,671 B2 7/2014 Van Os et al.
8,784,914 B2 7/2014 Leloup et al.
8,784,915 B2 7/2014 Evers et al.
8,794,439 B2 8/2014 Charles
8,800,820 B2 8/2014 Girard et al.
8,808,777 B2 8/2014 Kamerbeek et al.
8,839,710 B2 9/2014 Accursi
8,906,435 B2 12/2014 Kamerbeek et al.
8,962,049 B2 2/2015 Doleac et al.
9,783,361 B2 10/2017 Koller et al.
2001/0000570 A1 5/2001 Aarts
2002/0078831 A1 6/2002 Cai
2002/0098268 A1 7/2002 Cohen et al.
2003/0012850 A1 1/2003 Turmel
2003/0054089 A1 3/2003 Prosise et al.
2003/0066431 A1 4/2003 Fanzutti et al.
2003/0096038 A1 5/2003 Cai
2003/0127455 A1 7/2003 Poss
2004/0005384 A1 1/2004 Cai
2004/0115310 A1 6/2004 Yoakim et al.
2004/0150390 A1 8/2004 Tsuge et al.
2004/0166202 A1 8/2004 Prosise et al.
2004/0185149 A1 9/2004 Prosise et al.
2004/0265436 A1 12/2004 Cai
2005/0003060 A1 1/2005 Steenhof et al.
2005/0051478 A1 3/2005 Karanikos et al.
2005/0150390 A1 7/2005 Schifferle
2005/0150391 A1 7/2005 Schifferle
2005/0158426 A1 7/2005 Hu et al.
2005/0166763 A1 8/2005 Cox et al.
2005/0183581 A1 8/2005 Kirschner et al.
2005/0266122 A1 12/2005 Franceschi
2006/0011066 A1 1/2006 Bunn et al.
2006/0018986 A1 1/2006 Breton
2006/0021930 A1 2/2006 Cai
2006/0065127 A1 3/2006 Dalton et al.
2006/0075903 A1 4/2006 Dijs
2006/0169149 A1 8/2006 Voss et al.
2006/0219098 A1 10/2006 Mandralis et al.
2006/0236871 A1 10/2006 Ternite et al.
2006/0280841 A1 12/2006 Cai
2007/0062375 A1 3/2007 Liverani et al.
2007/0122526 A1 5/2007 Sweeney et al.
2007/0148290 A1 6/2007 Ternite et al.
2007/0157822 A1 7/2007 Fusco
2007/0158366 A1 7/2007 Van Deer Meer et al.
2007/0163446 A1 7/2007 Halliday et al.
2007/0175334 A1 8/2007 Halliday et al.
2007/0181005 A1 8/2007 Kirschner et al.
2007/0181614 A1 8/2007 Rvachov et al.
2007/0261564 A1 11/2007 Suggi Liverani et al.
2007/0267409 A1 11/2007 Gard et al.
2007/0289453 A1 12/2007 Halliday et al.
2007/0292584 A1 12/2007 Arrick et al.
2008/0026121 A1 1/2008 Mastropasqua
2008/0028946 A1 2/2008 Kirschner et al.
2008/0089982 A1 4/2008 Brouwer et al.
2008/0105130 A1 5/2008 Koeling et al.
2008/0148958 A1 6/2008 Koeling et al.
2008/0187638 A1 8/2008 Hansen
2008/0196593 A1 8/2008 Shrader et al.
2008/0254169 A1 10/2008 MacMahon et al.
2008/0260928 A1 10/2008 MacMahon et al.
2008/0295697 A1 12/2008 Kim
2008/0299262 A1* 12/2008 Reati ..... B65B 29/022
426/84
2008/0317931 A1 12/2008 Mandralis et al.
2009/0004335 A1 1/2009 MacMahon et al.
2009/0007796 A1 1/2009 Ricotti
2009/0017177 A1 1/2009 Yoakim et al.
2009/0022855 A1 1/2009 Steenhof et al.
2009/0022864 A1 1/2009 Steenhof et al.
2009/0035438 A1 2/2009 Cortese
2009/0047389 A1 2/2009 Jarisch et al.
2009/0104336 A1 4/2009 Fraij et al.
2009/0126577 A1 5/2009 Ternite
2009/0133584 A1 5/2009 De Graaff et al.
2009/0178571 A1 7/2009 Brouwer et al.
2009/0183640 A1 7/2009 Ozanne
2009/0211456 A1 8/2009 De Graaff et al.
2009/0211458 A1 8/2009 Denisart et al.
2009/0214713 A1 8/2009 Banim et al.
2009/0217823 A1 9/2009 De Graaff et al.
2009/0219140 A1 9/2009 Guard et al.
2009/0223373 A1 9/2009 Kollep et al.
2009/0223377 A1 9/2009 Voss et al.
2009/0232944 A1 9/2009 MacMahon et al.
2009/0232947 A1 9/2009 Buisson et al.
2009/0235825 A1 9/2009 De Graaff et al.
2009/0263545 A1 10/2009 Ozanne
2009/0272274 A1 11/2009 De Graaff et al.
2009/0272275 A1 11/2009 De Graaff et al.
2009/0280219 A1 11/2009 Yoakim et al.
2009/0282987 A1 11/2009 MacMahon et al.
2009/0311384 A1 12/2009 MacMahon et al.
2009/0314167 A1 12/2009 De Graaff et al.
2009/0317518 A1 12/2009 York et al.
2009/0320692 A1 12/2009 Simanski
2009/0320693 A1 12/2009 Ozanne
2010/0000415 A1 1/2010 Vanni
2010/0003371 A1 1/2010 Ozanne
2010/0004185 A1 1/2010 Kannar et al.
2010/0005973 A1 1/2010 Doglioni
2010/0009039 A1 1/2010 Robinson et al.
2010/0015307 A1 1/2010 Abegglen et al.
2010/0028495 A1 2/2010 Novak et al.
2010/0034929 A1 2/2010 Dogan et al.
2010/0043644 A1 2/2010 Suggi Liverani et al.
2010/0043645 A1 2/2010 Suggi Liverani et al.
2010/0043646 A1 2/2010 Suggi Liverani et al.
2010/0044485 A1 2/2010 Delbridge et al.
2010/0077928 A1 4/2010 Schmed et al.
2010/0078446 A1 4/2010 Halliday et al.
2010/0119685 A1 5/2010 van Bergen
2010/0132564 A1 6/2010 Ozanne et al.
2010/0136183 A1 6/2010 Gonus et al.
2010/0147154 A1 6/2010 De Graaff et al.
2010/0147156 A1 6/2010 Colantonio et al.
2010/0147873 A1 6/2010 Tanner et al.
2010/0163440 A1 7/2010 Tsang
2010/0173055 A1 7/2010 Brouwer et al.
2010/0178391 A1 7/2010 MacMahon et al.

(56) References Cited

U.S. PATENT DOCUMENTS

2010/0178392 A1 7/2010 Yoakim et al.
2010/0180774 A1 7/2010 Kollep et al.
2010/0180775 A1 7/2010 Kollep et al.
2010/0186599 A1 7/2010 Yoakim et al.
2010/0189844 A1 7/2010 Brouwer et al.
2010/0203198 A1 8/2010 Yoakim et al.
2010/0239717 A1 9/2010 Yoakim et al.
2010/0239733 A1 9/2010 Yoakim et al.
2010/0239734 A1 9/2010 Yoakim et al.
2010/0260895 A1 10/2010 Yoakim et al.
2010/0260896 A1 10/2010 Yoakim et al.
2010/0282091 A1 11/2010 Doleac et al.
2010/0285186 A1 11/2010 Kannar et al.
2010/0297299 A1 11/2010 Epars et al.
2010/0303964 A1 12/2010 Beaulieu et al.
2010/0303997 A1 12/2010 Fulton
2010/0307930 A1 12/2010 Zangerle
2010/0313766 A1 12/2010 Navarini et al.
2010/0323068 A1 12/2010 Gonus et al.
2010/0326283 A1 12/2010 Evers et al.
2011/0003040 A1 1/2011 Graf et al.
2011/0005399 A1 1/2011 Epars et al.
2011/0011273 A1 1/2011 Evers et al.
2011/0020497 A1 1/2011 Steven et al.
2011/0020500 A1 1/2011 Eichler et al.
2011/0027425 A1 2/2011 Heijdel et al.
2011/0033580 A1 2/2011 Biesheuvel et al.
2011/0041702 A1 2/2011 Yoakim et al.
2011/0045144 A1 2/2011 Boussemart et al.
2011/0052754 A1 3/2011 Foley
2011/0052761 A1 3/2011 Yoakim et al.
2011/0076360 A1 3/2011 Schnabel
2011/0076361 A1 3/2011 Peterson et al.
2011/0079152 A1 4/2011 Mariller
2011/0113968 A1 5/2011 Schmed et al.
2011/0132199 A1 6/2011 Vanni
2011/0135802 A1 6/2011 Robinson et al.
2011/0135803 A1 6/2011 Robinson et al.
2011/0151075 A1 6/2011 Peterson
2011/0171350 A1 7/2011 Remo
2011/0185910 A1 8/2011 Ryser
2011/0186450 A1 8/2011 Bonacci
2011/0212225 A1 9/2011 Mariller
2011/0248037 A1 10/2011 Fung
2011/0262597 A1 10/2011 Bennett et al.
2011/0271843 A1 11/2011 Cheng et al.
2011/0271844 A1 11/2011 Mariller et al.
2011/0283891 A1 11/2011 Mariller
2011/0297005 A1 12/2011 Mariller
2011/0305792 A1 12/2011 Vella et al.
2011/0305807 A1 12/2011 Koeling et al.
2011/0311694 A1 12/2011 Broennimann et al.
2012/0006205 A1 1/2012 Vanni
2012/0024160 A1 2/2012 Van Os et al.
2012/0031279 A1 2/2012 Mariller et al.
2012/0031280 A1* 2/2012 Macchi ..... B65D 85/8043 99/295
2012/0051672 A1 3/2012 Foss et al.
2012/0070542 A1 3/2012 Camera et al.
2012/0070543 A1 3/2012 Mahlich
2012/0070544 A1 3/2012 Van der Veen et al.
2012/0093990 A1 4/2012 Shrader et al.
2012/0097602 A1 4/2012 Tedford
2012/0121765 A1 5/2012 Kamerbeek et al.
2012/0121780 A1 5/2012 Lai et al.
2012/0125202 A1 5/2012 Remo et al.
2012/0148709 A1 6/2012 Flamand et al.
2012/0171332 A1 7/2012 Lai et al.
2012/0182825 A1 7/2012 Rime
2012/0189740 A1 7/2012 Ozanne et al.
2012/0199009 A1 8/2012 Zogg et al.
2012/0199010 A1 8/2012 Mariller
2012/0201933 A1 8/2012 Dran et al.
2012/0231123 A1 9/2012 Kamerbeek et al.
2012/0231124 A1 9/2012 Kamerbeek et al.
2012/0231133 A1 9/2012 Kamerbeek et al.
2012/0240777 A1 9/2012 Righetti
2012/0251668 A1 10/2012 Wong et al.
2012/0251669 A1 10/2012 Kamerbeek et al.
2012/0251670 A1 10/2012 Kamerbeek et al.
2012/0251671 A1 10/2012 Kamerbeek et al.
2012/0251672 A1 10/2012 Kamerbeek et al.
2012/0251694 A1 10/2012 Wong et al.
2012/0258210 A1 10/2012 Wong et al.
2012/0258219 A1 10/2012 Biesheuvel et al.
2012/0258221 A1 10/2012 Biesheuvel et al.
2012/0263829 A1 10/2012 Kamerbeek et al.
2012/0263830 A1 10/2012 Kamerbeek et al.
2012/0263833 A1 10/2012 Wong et al.
2012/0267395 A1 10/2012 Biewenga
2012/0276252 A1 11/2012 Bolinger et al.
2012/0276264 A1 11/2012 Rivera
2012/0328740 A1 12/2012 Nocera
2013/0011521 A1 1/2013 Weijers et al.
2013/0040021 A1 2/2013 Digiuni
2013/0045308 A1 2/2013 Gorbatenko
2013/0055902 A1 3/2013 Berto et al.
2013/0068108 A1 3/2013 Rivera
2013/0071532 A1 3/2013 Pribus et al.
2013/0081363 A1 4/2013 Kunik et al.
2013/0095218 A1 4/2013 De Graaff et al.
2013/0095219 A1 4/2013 De Graaff et al.
2013/0101716 A1 4/2013 Beaulieu et al.
2013/0101717 A1 4/2013 De Graaff et al.
2013/0115351 A1 5/2013 Van Os et al.
2013/0122153 A1 5/2013 Ferrier et al.
2013/0122167 A1 5/2013 Winkler et al.
2013/0214073 A1 8/2013 Scharf et al.
2013/0230625 A1 9/2013 Brouwer et al.
2013/0243919 A1 9/2013 Shrader et al.
2013/0245839 A1 9/2013 Daburger et al.
2013/0295240 A1 11/2013 Wong et al.
2013/0312620 A1 11/2013 Mariller
2013/0319252 A1 12/2013 Castelli et al.
2013/0341478 A1 12/2013 Mariller
2014/0010926 A1 1/2014 Digiuni
2014/0037802 A1 2/2014 Cardoso
2014/0065269 A1 3/2014 Favre
2014/0076167 A1 3/2014 Boggavarapu
2014/0106036 A1 4/2014 Cardoso
2014/0161940 A1 6/2014 Aviles et al.
2014/0174300 A1 6/2014 Husband et al.
2014/0178538 A1 6/2014 Husband et al.
2014/0205725 A1 7/2014 Albanese
2014/0208691 A1 7/2014 Ballering
2014/0220189 A1 8/2014 Giovanni
2014/0220190 A1 8/2014 Giovanni
2014/0220205 A1 8/2014 Kamerbeek et al.
2014/0227403 A1 8/2014 Fischer
2014/0242224 A1 8/2014 Glucksman et al.
2014/0242239 A1 8/2014 Boggavarapu
2014/0242309 A1 8/2014 Foss et al.
2014/0272018 A1 9/2014 Koller et al.
2014/0272078 A1 9/2014 Bolanos
2015/0110929 A1 4/2015 Camera et al.
2015/0201796 A1 7/2015 Kuempel et al.
2016/0145038 A1 5/2016 Apone et al.
2016/0214787 A1 7/2016 Iotti
2018/0072490 A1 3/2018 Koller et al.

FOREIGN PATENT DOCUMENTS

CA 2400033 8/2001
CA 2366837 A1 7/2002
CA 2349507 A1 12/2002
CA 2780774 A1 1/2003
CA 2108753 5/2004
CA 2108753 C 5/2004
CA 2513719 8/2004
CA 2513723 8/2004
CA 2513765 8/2004
CA 2513995 8/2004
CA 2514072 8/2004
CA 2514144 8/2004

(56) References Cited

FOREIGN PATENT DOCUMENTS

| | | | |
|---|---|---|---|
| CA | 2547583 | | 6/2005 |
| CA | 2555089 | | 9/2005 |
| CA | 2555329 | | 9/2005 |
| CA | 2555775 | | 9/2005 |
| CA | 2556421 | | 9/2005 |
| CA | 2560841 | | 10/2005 |
| CA | 2560846 | | 10/2005 |
| CA | 2399290 | | 1/2006 |
| CA | 2574961 | | 2/2006 |
| CA | 2581630 | A1 | 4/2006 |
| CA | 2448474 | C | 12/2006 |
| CA | 2622933 | | 4/2007 |
| CA | 2650388 | | 11/2007 |
| CA | 2651921 | | 11/2007 |
| CA | 2656878 | A1 | 1/2008 |
| CA | 2657846 | | 1/2008 |
| CA | 2660119 | | 2/2008 |
| CA | 2661921 | A1 | 3/2008 |
| CA | 2629268 | | 10/2008 |
| CA | 2684669 | | 11/2008 |
| CA | 2686347 | A1 | 12/2008 |
| CA | 2701826 | A1 | 1/2009 |
| CA | 2517624 | C | 4/2009 |
| CA | 2643479 | | 5/2009 |
| CA | 2713149 | A1 | 9/2009 |
| CA | 2697823 | | 9/2010 |
| CA | 2496416 | C | 10/2010 |
| CA | 2764942 | A1 | 12/2010 |
| CA | 2764946 | A1 | 12/2010 |
| CA | 2764949 | A1 | 12/2010 |
| CA | 2765131 | A1 | 12/2010 |
| CA | 2765132 | A1 | 12/2010 |
| CA | 2765134 | A1 | 12/2010 |
| CA | 2765136 | A1 | 12/2010 |
| CA | 2765320 | A1 | 12/2010 |
| CA | 2765322 | A1 | 12/2010 |
| CA | 2765323 | A1 | 12/2010 |
| CA | 2765324 | A1 | 12/2010 |
| CA | 2765325 | A1 | 12/2010 |
| CA | 2765383 | A1 | 12/2010 |
| CA | 2765388 | A1 | 12/2010 |
| CA | 2765456 | A1 | 12/2010 |
| CA | 2765468 | A1 | 12/2010 |
| CA | 2521063 | C | 5/2011 |
| CA | 2662071 | C | 7/2011 |
| CA | 2538256 | | 8/2011 |
| CA | 2531544 | C | 5/2012 |
| CA | 2662069 | C | 1/2013 |
| CN | 104955744 | A | 9/2015 |
| DE | 3140244 | | 4/1983 |
| DE | 3501786 | | 7/1986 |
| DE | 29708504 | U1 | 6/1998 |
| DE | 102004056224 | | 5/2006 |
| DE | 102005016297 | | 10/2006 |
| DE | 202006013189 | | 11/2006 |
| DE | 202004021229 | | 5/2007 |
| DE | 102005058336 | | 6/2007 |
| DE | 602004007479 | | 4/2008 |
| EP | 57671 | | 8/1982 |
| EP | 114717 | | 8/1984 |
| EP | 188299 | | 7/1986 |
| EP | 224297 | | 6/1987 |
| EP | 272922 | | 6/1988 |
| EP | 309708 | | 4/1989 |
| EP | 337615 | | 10/1989 |
| EP | 389141 | | 9/1990 |
| EP | 493856 | | 12/1990 |
| EP | 449533 | | 10/1991 |
| EP | 451980 | | 10/1991 |
| EP | 455337 | | 11/1991 |
| EP | 468079 | | 1/1992 |
| EP | 471094 | | 2/1992 |
| EP | 512148 | | 11/1992 |
| EP | 512468 | | 11/1992 |
| EP | 521510 | | 1/1993 |
| EP | 524464 | | 1/1993 |
| EP | 377849 | | 4/1993 |
| EP | 554469 | | 8/1993 |
| EP | 638486 | | 8/1994 |
| EP | 615921 | | 9/1994 |
| EP | 584314 | | 7/1996 |
| EP | 761148 | | 3/1997 |
| EP | 806373 | | 11/1997 |
| EP | 821906 | | 2/1998 |
| EP | 844195 | | 5/1998 |
| EP | 860375 | | 8/1998 |
| EP | 904717 | | 3/1999 |
| EP | 0958770 | A1 | 11/1999 |
| EP | 1042978 | | 10/2000 |
| EP | 1166697 | | 1/2002 |
| EP | 1167204 | | 1/2002 |
| EP | 1188400 | | 3/2002 |
| EP | 1190959 | | 3/2002 |
| EP | 1243210 | | 9/2002 |
| EP | 1247756 | | 10/2002 |
| EP | 1221418 | | 5/2003 |
| EP | 1369356 | | 12/2003 |
| EP | 1440636 | | 7/2004 |
| EP | 1440903 | | 7/2004 |
| EP | 1440904 | | 7/2004 |
| EP | 1440905 | | 7/2004 |
| EP | 1440907 | | 7/2004 |
| EP | 1440908 | | 7/2004 |
| EP | 1440909 | | 7/2004 |
| EP | 1440911 | | 7/2004 |
| EP | 1440912 | | 7/2004 |
| EP | 1440913 | | 7/2004 |
| EP | 1440914 | | 7/2004 |
| EP | 1462042 | | 9/2004 |
| EP | 1529739 | | 5/2005 |
| EP | 1398279 | | 6/2005 |
| EP | 1574452 | | 9/2005 |
| EP | 1579791 | | 9/2005 |
| EP | 1579792 | | 9/2005 |
| EP | 1579793 | | 9/2005 |
| EP | 1580143 | | 9/2005 |
| EP | 1580144 | | 9/2005 |
| EP | 1604915 | | 12/2005 |
| EP | 1654966 | | 5/2006 |
| EP | 1440910 | | 6/2006 |
| EP | 1676786 | | 7/2006 |
| EP | 1700548 | | 9/2006 |
| EP | 1702543 | | 9/2006 |
| EP | 1710173 | | 10/2006 |
| EP | 1599395 | | 1/2007 |
| EP | 1608569 | | 1/2007 |
| EP | 1440906 | | 3/2007 |
| EP | 1767467 | | 3/2007 |
| EP | 1418135 | | 5/2007 |
| EP | 1785369 | | 5/2007 |
| EP | 1646304 | | 7/2007 |
| EP | 1808382 | | 7/2007 |
| EP | 1815750 | | 8/2007 |
| EP | 1826148 | | 8/2007 |
| EP | 1839543 | | 10/2007 |
| EP | 1847481 | | 10/2007 |
| EP | 1849715 | | 10/2007 |
| EP | 1864917 | | 12/2007 |
| EP | 1886942 | | 2/2008 |
| EP | 1547499 | | 3/2008 |
| EP | 1908706 | | 4/2008 |
| EP | 1716069 | | 5/2008 |
| EP | 1929904 | | 6/2008 |
| EP | 1775234 | | 7/2008 |
| EP | 1974638 | | 10/2008 |
| EP | 1975087 | | 10/2008 |
| EP | 1977651 | | 10/2008 |
| EP | 1980155 | | 10/2008 |
| EP | 1982933 | | 10/2008 |
| EP | 1985213 | | 10/2008 |
| EP | 1792850 | | 11/2008 |
| EP | 1997748 | | 12/2008 |
| EP | 1894850 | | 5/2009 |
| EP | 2058243 | | 5/2009 |

(56) References Cited

FOREIGN PATENT DOCUMENTS

| | | | |
|---|---|---|---|
| EP | 2062831 | | 5/2009 |
| EP | 2070454 | | 6/2009 |
| EP | 2093164 | | 8/2009 |
| EP | 2095716 | | 9/2009 |
| EP | 2098144 | | 9/2009 |
| EP | 2100824 | | 9/2009 |
| EP | 1894854 | | 11/2009 |
| EP | 2119640 | | 11/2009 |
| EP | 1892199 | | 12/2009 |
| EP | 2151313 | | 2/2010 |
| EP | 2165937 | | 3/2010 |
| EP | 2168469 | | 3/2010 |
| EP | 2134611 | | 6/2010 |
| EP | 1983871 | | 7/2010 |
| EP | 2210540 | | 7/2010 |
| EP | 2210826 | | 7/2010 |
| EP | 2210827 | | 7/2010 |
| EP | 1811880 | | 8/2010 |
| EP | 2037782 | | 8/2010 |
| EP | 2228320 | | 9/2010 |
| EP | 2230195 | | 9/2010 |
| EP | 2233051 | | 9/2010 |
| EP | 2236060 | | 10/2010 |
| EP | 2236437 | | 10/2010 |
| EP | 2239211 | | 10/2010 |
| EP | 2239212 | | 10/2010 |
| EP | 2263501 | | 12/2010 |
| EP | 2279845 | | 2/2011 |
| EP | 2284100 | | 2/2011 |
| EP | 2284101 | | 2/2011 |
| EP | 2284102 | | 2/2011 |
| EP | 2287090 | | 2/2011 |
| EP | 2139792 | | 3/2011 |
| EP | 2289820 | | 3/2011 |
| EP | 2298667 | | 3/2011 |
| EP | 2308776 | | 4/2011 |
| EP | 2155586 | | 7/2011 |
| EP | 2343247 | | 7/2011 |
| EP | 2345351 | | 7/2011 |
| EP | 2345602 | | 7/2011 |
| EP | 2364930 | | 9/2011 |
| EP | 2374733 | A1 | 10/2011 |
| EP | 2234522 | | 12/2011 |
| EP | 2465792 | | 6/2012 |
| EP | 2166903 | | 8/2012 |
| EP | 2484605 | | 8/2012 |
| EP | 2367741 | | 9/2012 |
| EP | 2510802 | | 10/2012 |
| EP | 2510803 | | 10/2012 |
| EP | 2510804 | | 10/2012 |
| EP | 2510805 | | 10/2012 |
| EP | 1894853 | | 11/2012 |
| EP | 2367736 | | 5/2013 |
| EP | 2426065 | | 5/2013 |
| EP | 13183463.2 | | 9/2013 |
| EP | 2510843 | | 10/2013 |
| EP | 2387922 | | 3/2015 |
| FR | 2543814 | A1 | 10/1984 |
| GB | 1376074 | | 12/1974 |
| GB | 2009590 | A | 6/1979 |
| GB | 2138320 | A | 10/1984 |
| GB | 2392834 | A | 3/2004 |
| GB | 2392899 | A | 3/2004 |
| IT | 1210982 | A | 9/1989 |
| IT | 1256690 | | 3/1992 |
| IT | 1307241 | | 4/1999 |
| JP | H04-83131 | | 7/1992 |
| JP | 2005-199071 | | 7/2005 |
| JP | 2012-530525 | | 12/2012 |
| JP | 2012-530534 | | 12/2012 |
| JP | 2013-505810 | | 2/2013 |
| NL | 8500029 | A | 8/1986 |
| NL | 8503092 | A | 6/1987 |
| NL | 8600958 | A | 11/1987 |
| NL | 9002815 | A | 7/1992 |
| NL | 9400837 | A | 1/1996 |
| NL | 1001120 | C2 | 3/1997 |
| NL | 1002929 | C2 | 10/1997 |
| NL | 1003716 | C2 | 2/1998 |
| NL | 1005328 | C2 | 8/1998 |
| NL | 1007171 | C2 | 3/1999 |
| NL | 1019013 | C2 | 3/2003 |
| NL | 1020835 | C2 | 12/2003 |
| NL | 1021325 | C2 | 2/2004 |
| NL | 1024012 | C2 | 2/2005 |
| NL | 1024160 | C2 | 2/2005 |
| NL | 1026068 | C2 | 10/2005 |
| NL | 1026437 | C2 | 12/2005 |
| NL | 1026834 | C2 | 2/2006 |
| NL | 1029155 | C2 | 4/2006 |
| NL | 1028101 | C2 | 7/2006 |
| NL | 1029503 | C2 | 1/2007 |
| NL | 1032292 | C2 | 5/2007 |
| NL | 1031622 | C2 | 10/2007 |
| NL | 1032080 | C2 | 10/2007 |
| NL | 1032081 | C2 | 10/2007 |
| NL | 1032082 | C2 | 10/2007 |
| NL | 1032085 | C2 | 10/2007 |
| NL | 1032087 | C2 | 10/2007 |
| NL | 1032090 | C2 | 10/2007 |
| NL | 1032091 | C2 | 10/2007 |
| NL | 1033968 | C2 | 12/2008 |
| NL | 2001539 | C2 | 10/2009 |
| WO | WO 1992/007775 | | 5/1992 |
| WO | WO 93/017932 | | 9/1993 |
| WO | WO 1996/013179 | A2 | 5/1996 |
| WO | WO 1997/018721 | A1 | 5/1997 |
| WO | WO 00/056629 | | 9/2000 |
| WO | WO 2000/051478 | | 9/2000 |
| WO | WO 01/058786 | | 8/2001 |
| WO | WO 01/060219 | | 8/2001 |
| WO | WO 01/060220 | | 8/2001 |
| WO | WO 01/060712 | | 8/2001 |
| WO | WO 2001/078522 | A2 | 10/2001 |
| WO | WO 2001/078523 | A2 | 10/2001 |
| WO | WO 2002/058522 | | 8/2002 |
| WO | WO 02/080744 | | 10/2002 |
| WO | WO 02/081327 | | 10/2002 |
| WO | WO 02/082963 | | 10/2002 |
| WO | WO 2003/030696 | A1 | 4/2003 |
| WO | WO 03/059778 | | 7/2003 |
| WO | WO 2003/073896 | | 9/2003 |
| WO | WO 2004/005136 | | 1/2004 |
| WO | WO 2004/018326 | | 3/2004 |
| WO | WO 2004/023956 | A1 | 3/2004 |
| WO | WO 2004/026091 | | 4/2004 |
| WO | WO 2004/054535 | A1 | 7/2004 |
| WO | WO 2004/064584 | | 8/2004 |
| WO | WO 2004/065225 | | 8/2004 |
| WO | WO 2004/065256 | | 8/2004 |
| WO | WO 2004/065257 | | 8/2004 |
| WO | WO 2004/065258 | | 8/2004 |
| WO | WO 2004/065259 | | 8/2004 |
| WO | WO 2004/073420 | A1 | 9/2004 |
| WO | WO 2004/083071 | | 9/2004 |
| WO | WO 2004/084687 | | 10/2004 |
| WO | WO 2005/009865 | | 2/2005 |
| WO | WO 2005/018394 | | 3/2005 |
| WO | WO 2005/026018 | | 3/2005 |
| WO | WO 2005/054080 | | 6/2005 |
| WO | WO 2005/056423 | | 6/2005 |
| WO | WO 2005/066040 | | 7/2005 |
| WO | WO 2005/079637 | | 9/2005 |
| WO | WO 2005/079638 | | 9/2005 |
| WO | WO 2005/079639 | | 9/2005 |
| WO | WO 2005/080222 | | 9/2005 |
| WO | WO 2005/092160 | | 10/2005 |
| WO | WO 2005/092162 | | 10/2005 |
| WO | WO 2005/105609 | | 11/2005 |
| WO | WO 2005/122780 | | 12/2005 |
| WO | WO 2005/122851 | | 12/2005 |
| WO | WO 2006/008243 | | 1/2006 |
| WO | WO 2006/014936 | | 2/2006 |
| WO | WO 2006/016813 | | 2/2006 |

(56) References Cited

FOREIGN PATENT DOCUMENTS

| | | | |
|---|---|---|---|
| WO | WO 2006/021405 | | 3/2006 |
| WO | WO 2006/037062 | | 4/2006 |
| WO | WO 2006/043096 | | 4/2006 |
| WO | WO 2006/043098 | | 4/2006 |
| WO | WO 2006/043102 | | 4/2006 |
| WO | WO 2006/043103 | | 4/2006 |
| WO | WO 2006/043104 | | 4/2006 |
| WO | WO 2006/043106 | | 4/2006 |
| WO | WO 2006/043108 | | 4/2006 |
| WO | WO 2006/045536 | | 5/2006 |
| WO | WO 2006/045537 | | 5/2006 |
| WO | WO 2006/057022 | | 6/2006 |
| WO | WO 2006/043109 | | 7/2006 |
| WO | WO 2007/008067 | | 1/2007 |
| WO | WO 2007/025773 | | 3/2007 |
| WO | WO 2007/039032 | | 4/2007 |
| WO | WO 2007/042414 | | 4/2007 |
| WO | WO 2007/052929 | A1 | 5/2007 |
| WO | WO 2007/054479 | | 5/2007 |
| WO | WO 2007/056097 | | 5/2007 |
| WO | WO 2007/072020 | A2 | 6/2007 |
| WO | WO 2007/080461 | A1 | 7/2007 |
| WO | WO 2007/096196 | | 8/2007 |
| WO | WO 2007/113100 | | 10/2007 |
| WO | WO 2007/116429 | A1 | 10/2007 |
| WO | WO 2007/120045 | | 10/2007 |
| WO | WO 2007/120046 | | 10/2007 |
| WO | WO 2007/120047 | | 10/2007 |
| WO | WO 2007/120048 | | 10/2007 |
| WO | WO 2007/120049 | | 10/2007 |
| WO | WO 2007/120050 | | 10/2007 |
| WO | WO 2007/120051 | | 10/2007 |
| WO | WO 2007/120052 | | 10/2007 |
| WO | WO 2007/122206 | | 11/2007 |
| WO | WO 2007/122208 | | 11/2007 |
| WO | WO 2007/125337 | | 11/2007 |
| WO | WO 2007/131559 | | 11/2007 |
| WO | WO 2007/137974 | | 12/2007 |
| WO | WO 2007/141202 | | 12/2007 |
| WO | WO 2007/141557 | A1 | 12/2007 |
| WO | WO 2008/011913 | | 1/2008 |
| WO | WO 2008/012202 | A1 | 1/2008 |
| WO | WO 2008/012203 | A1 | 1/2008 |
| WO | WO 2008/018794 | | 2/2008 |
| WO | WO 2008/025715 | | 3/2008 |
| WO | WO 2008/025730 | | 3/2008 |
| WO | WO 2008/025785 | | 3/2008 |
| WO | WO 2008/034180 | A1 | 3/2008 |
| WO | WO 2008/087553 | | 7/2008 |
| WO | WO 2008/090122 | | 7/2008 |
| WO | WO 2008/100597 | A1 | 8/2008 |
| WO | WO 2008/113779 | | 9/2008 |
| WO | WO 2008/116818 | | 10/2008 |
| WO | WO 2008/123775 | | 10/2008 |
| WO | WO 2008/126045 | | 10/2008 |
| WO | WO 2008/129053 | | 10/2008 |
| WO | WO 2008/132571 | | 11/2008 |
| WO | WO 2008/143671 | A1 | 11/2008 |
| WO | WO 2008/144462 | | 11/2008 |
| WO | WO 2008/148604 | | 12/2008 |
| WO | WO 2008/148650 | | 12/2008 |
| WO | WO 2008/148834 | | 12/2008 |
| WO | WO 2008/153383 | | 12/2008 |
| WO | WO 2009/043100 | A1 | 4/2009 |
| WO | WO 2009/046771 | A1 | 4/2009 |
| WO | WO 2009/053811 | | 4/2009 |
| WO | WO 2009/092628 | | 7/2009 |
| WO | WO 2009/092629 | | 7/2009 |
| WO | WO 2009/110783 | | 9/2009 |
| WO | WO 2009/112291 | | 9/2009 |
| WO | WO 2009/114119 | | 9/2009 |
| WO | WO 2009/115475 | | 9/2009 |
| WO | WO 2009/128016 | | 10/2009 |
| WO | WO 2009/133134 | | 11/2009 |
| WO | WO 2010/006936 | | 1/2010 |
| WO | WO 2010/009975 | | 1/2010 |
| WO | WO 2010/014201 | | 2/2010 |
| WO | WO 2010/016753 | | 2/2010 |
| WO | WO 2010/018540 | | 2/2010 |
| WO | WO 2010/033023 | | 3/2010 |
| WO | WO 2010/038213 | | 4/2010 |
| WO | WO 2010/041179 | | 4/2010 |
| WO | WO 2010/055465 | A1 | 5/2010 |
| WO | WO 2010/066705 | | 6/2010 |
| WO | WO 2010/066736 | | 6/2010 |
| WO | WO 2010/076048 | | 7/2010 |
| WO | WO 2010/076698 | | 7/2010 |
| WO | WO 2010/079454 | | 7/2010 |
| WO | WO 2010/081252 | A1 | 7/2010 |
| WO | WO 2010/084475 | | 7/2010 |
| WO | WO 2010/092543 | | 8/2010 |
| WO | WO 2010/095937 | | 8/2010 |
| WO | WO 2010/106516 | | 9/2010 |
| WO | WO 2010/112353 | | 10/2010 |
| WO | WO 2010/116284 | | 10/2010 |
| WO | WO 2010/126365 | | 11/2010 |
| WO | WO 2010/128028 | | 11/2010 |
| WO | WO 2010/128031 | | 11/2010 |
| WO | WO 2010/128051 | | 11/2010 |
| WO | WO 2010/128109 | A1 | 11/2010 |
| WO | WO 2010/128844 | | 11/2010 |
| WO | WO 2010/134036 | | 11/2010 |
| WO | WO 2010/137945 | | 12/2010 |
| WO | WO 2010/137946 | | 12/2010 |
| WO | WO 2010/137947 | | 12/2010 |
| WO | WO 2010/137948 | | 12/2010 |
| WO | WO 2010/137949 | | 12/2010 |
| WO | WO 2010/137950 | | 12/2010 |
| WO | WO 2010/137951 | | 12/2010 |
| WO | WO 2010/137952 | | 12/2010 |
| WO | WO 2010/137953 | | 12/2010 |
| WO | WO 2010/137954 | | 12/2010 |
| WO | WO 2010/137955 | | 12/2010 |
| WO | WO 2010/137956 | | 12/2010 |
| WO | WO 2010/137957 | | 12/2010 |
| WO | WO 2010/137958 | | 12/2010 |
| WO | WO 2010/137959 | | 12/2010 |
| WO | WO 2010/137960 | | 12/2010 |
| WO | WO 2010/137961 | | 12/2010 |
| WO | WO 2010/137962 | | 12/2010 |
| WO | WO 2010/137963 | | 12/2010 |
| WO | WO 2010/137965 | | 12/2010 |
| WO | WO 2010/137966 | | 12/2010 |
| WO | WO 2010/138563 | | 12/2010 |
| WO | WO 2010/146101 | | 12/2010 |
| WO | WO 2011/000723 | | 1/2011 |
| WO | WO 2011/000725 | | 1/2011 |
| WO | WO 2011/015963 | A2 | 2/2011 |
| WO | WO 2011/015973 | | 2/2011 |
| WO | WO 2011/027259 | | 3/2011 |
| WO | WO 2011/029873 | | 3/2011 |
| WO | WO 2011/031294 | | 3/2011 |
| WO | WO 2011/037464 | | 3/2011 |
| WO | WO 2011/042489 | | 4/2011 |
| WO | WO 2011/045710 | A1 | 4/2011 |
| WO | WO 2011/048377 | | 4/2011 |
| WO | WO 2011/061126 | | 5/2011 |
| WO | WO 2011/069830 | | 6/2011 |
| WO | WO 2011/073052 | A1 | 6/2011 |
| WO | WO 2011/075638 | | 6/2011 |
| WO | WO 2011/089048 | | 7/2011 |
| WO | WO 2011/092301 | | 8/2011 |
| WO | WO 2011/102714 | A2 | 8/2011 |
| WO | WO 2011/102715 | A2 | 8/2011 |
| WO | WO 2011/102716 | A2 | 8/2011 |
| WO | WO 2011/102720 | A2 | 8/2011 |
| WO | WO 2011/102721 | A2 | 8/2011 |
| WO | WO 2011/117768 | | 9/2011 |
| WO | WO 2011/145064 | A1 | 11/2011 |
| WO | WO 2012/004878 | | 1/2012 |
| WO | WO 2012/019993 | A1 | 2/2012 |
| WO | WO 2012/021347 | A1 | 2/2012 |
| WO | WO 2012/022878 | A1 | 2/2012 |
| WO | WO 2012/031106 | A1 | 3/2012 |

(56) References Cited

FOREIGN PATENT DOCUMENTS

| | | | | |
|---|---|---|---|---|
| WO | WO 2012/077066 | | 6/2012 | |
| WO | WO 2012/080908 | | 6/2012 | |
| WO | WO 2012/104768 | | 8/2012 | |
| WO | WO 2012/120459 | | 9/2012 | |
| WO | WO 2012/122329 | | 9/2012 | |
| WO | WO 2012/125032 | A2 | 9/2012 | |
| WO | WO 2012/126789 | A1 | 9/2012 | |
| WO | WO 2012/127233 | | 9/2012 | |
| WO | WO 2012/134313 | A1 | 10/2012 | |
| WO | WO 2012/135204 | A1 | 10/2012 | |
| WO | WO 2012/150542 | | 11/2012 | |
| WO | WO 2012/164521 | | 12/2012 | |
| WO | WO 2012/166008 | A1 | 12/2012 | |
| WO | WO 2013/006718 | A1 | 1/2013 | |
| WO | WO 2013/028620 | A1 | 2/2013 | |
| WO | WO 2013/034334 | A1 | 3/2013 | |
| WO | WO 2013/043048 | | 3/2013 | |
| WO | WO 2013/066178 | | 5/2013 | |
| WO | WO 2013/080073 | | 6/2013 | |
| WO | WO 2013/115683 | A2 | 8/2013 | |
| WO | WO 2013/122460 | | 8/2013 | |
| WO | WO 2013/124234 | | 8/2013 | |
| WO | WO-2013132450 | A1 * | 9/2013 | ..... B65D 85/8043 |
| WO | WO 2013/143923 | A1 | 10/2013 | |
| WO | WO 2013/153473 | | 10/2013 | |
| WO | WO 2013/153526 | | 10/2013 | |
| WO | WO 2013/157924 | A1 | 10/2013 | |
| WO | WO 2013/167958 | A1 | 11/2013 | |
| WO | WO 2013/168083 | | 11/2013 | |
| WO | WO 2013/183023 | | 12/2013 | |
| WO | WO 2013/192569 | A2 | 12/2013 | |
| WO | WO 2014/003566 | A1 | 1/2014 | |
| WO | WO 2014/005872 | A1 | 1/2014 | |
| WO | WO 2014/005873 | A1 | 1/2014 | |
| WO | WO 2014/006527 | | 1/2014 | |
| WO | WO 2014/007639 | | 1/2014 | |
| WO | WO 2014/037842 | | 3/2014 | |
| WO | WO 2014/043652 | A1 | 3/2014 | |
| WO | WO 2014/044050 | A1 | 3/2014 | |
| WO | WO 2014/077398 | A1 | 5/2014 | |
| WO | WO 2014/093321 | A1 | 6/2014 | |
| WO | WO 2014/126463 | | 8/2014 | |
| WO | WO 2014/126464 | | 8/2014 | |
| WO | WO 2014/140836 | A2 | 9/2014 | |
| WO | WO 2014/158656 | A1 | 10/2014 | |
| WO | WO 2015/032787 | A1 | 3/2015 | |
| WO | WO 2015/138296 | A1 | 9/2015 | |
| WO | WO 2016/081307 | A1 | 5/2016 | |

OTHER PUBLICATIONS

A.G. Gonzalez et al., "HPLC analysis of tocopherols and triglycerides in coffee and their use as authentication parameters," Food Chemistry, vol. 73, Issue 1, Apr. 2001, pp. 93-101.

International Search Report and Written Opinion for PAT/US2015/019401 dated Aug. 10, 2015 in 11 pages.

* cited by examiner

POD-BASED RESTRICTORS AND METHODS

RELATED APPLICATIONS

This application is related to at least U.S. application Ser. No. 14/205,198, titled "SINGLE-SERVE BEVERAGE PRODUCTION MACHINE," which is filed on the same day as the present application; U.S. application Ser. No. 14/205,256, titled "BEVERAGE PRODUCTION MACHINES AND METHODS WITH MULTI-CHAMBERED BASKET UNITS," which is filed on the same day as the present application; U.S. application Ser. No. 14/205,261, titled "CARTRIDGE EJECTION SYSTEMS AND METHODS FOR SINGLE-SERVE BEVERAGE PRODUCTION MACHINES," which is filed on the same day as the present application; U.S. application Ser. No. 14/205,241, titled "BEVERAGE PRODUCTION MACHINES AND METHODS WITH TAMPING ASSEMBLY," which is filed on the same day as the present application; and U.S. application Ser. No. 14/205,232, titled "BEVERAGE PRODUCTION MACHINES AND METHODS WITH RESTRICTORS," which is filed on the same day as the present application. The entirety of each of the aforementioned applications is hereby incorporated herein by reference.

BACKGROUND

Field

The present disclosure relates to a cartridge containing a single serving of an instant beverage component for producing a beverage when fluid is introduced into the cartridge. The cartridge can be used with single-serve beverage machines.

Description of the Related Art

Single-serve beverage machines are devices that are designed to produce a single serving, or sometimes a single cup, of a desired beverage. In comparison to other types of beverage machines (such as drip coffee makers having a multi-cup carafe), single-serve beverage machines can enhance convenience by reducing the time to prepare the beverage.

Some single-serve beverage machines use a cartridge or capsule containing one or more beverage components or precursors to produce the beverage. Generally, such cartridges are received in the single-serve beverage machine, are used to produce the single serving of the beverage, and are subsequently manually removed from the machine and discarded.

BRIEF DESCRIPTION OF THE FIGURES

Various embodiments are depicted in the accompanying drawings for illustrative purposes, and should in no way be interpreted as limiting the scope of the embodiments. Furthermore, various features of different disclosed embodiments can be combined to form additional embodiments, which are part of this disclosure.

DETAILED DESCRIPTION

Figure 1A:
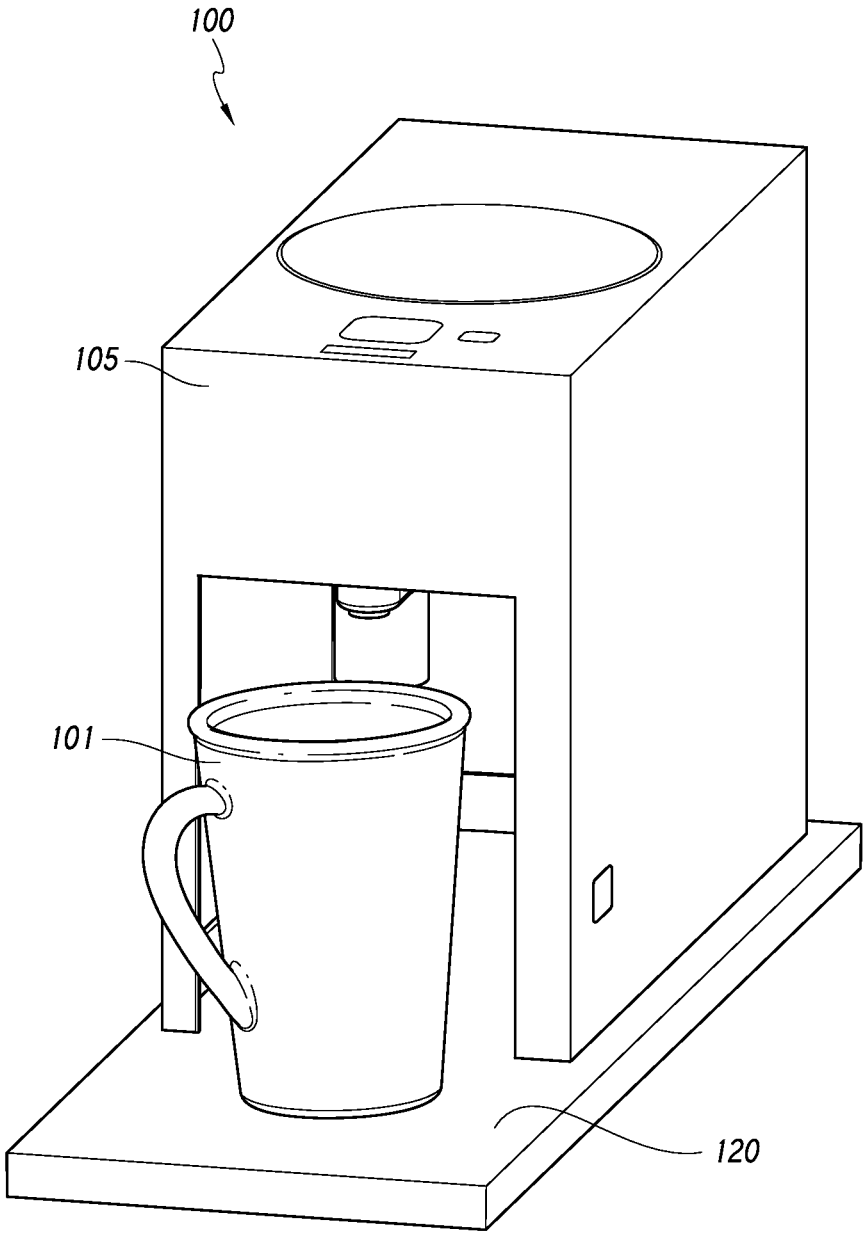
FIG. 1A illustrates an embodiment of a beverage production machine including a brewer.

The following discussion is presented to enable a person skilled in the art to make and use one or more of the present embodiments. The general principles described herein may be applied to embodiments and applications other than those detailed below without departing from the spirit and scope of the disclosure. Indeed, the present embodiments are not intended to be limited to the particular embodiments shown, but are to be accorded the widest scope consistent with the principles and features disclosed or suggested herein.

Various cartridge embodiments are described below to illustrate various examples that may be employed to achieve one or more desired improvements. These examples are only illustrative and not intended in any way to restrict the general disclosure presented and the various aspects and features of the disclosure. Certain aspects, advantages, and features of the inventions have been described herein. It is not necessary that any or all such aspects, advantages, and features are achieved in accordance with any particular embodiment. Indeed, not all embodiments achieve the advantages described herein, but may achieve different advantages instead. Any structure, feature, or step in one example is contemplated to be used in place of or in addition to any structure, feature, or step of any other example. No features, structure, or step disclosed herein is essential or indispensable.

Introduction

Different beverages can require preparation at different pressures. For example, brewed coffee can be prepared at a first pressure and espresso can be prepared at a second pressure that is greater than the first pressure. However, it can be difficult to vary pressure for different beverage recipes in a single machine. Accordingly, some aspects of the present disclosure describe a cartridge having at least one restricting orifice to limit the discharge of liquid from the cartridge and facilitate creating a pressure increase inside the cartridge, which can aid in the production of certain beverages (e.g., espresso) and/or can aid in compensating for certain inconsistencies in the beverage component or precursor (e.g., due to variations in the grind, tamping, settling or disruption during shipping, or otherwise). Some implementations of the restricting orifice can provide, and/or facilitate the creation of, at least about 9 bar of pressure in the cartridge during use.

Certain aspects of the disclosure are directed toward a single-serve beverage cartridge including a generally hollow body portion having a chamber, a sidewall, a first end, and a second end. The second end can include at least one restricting orifice. The chamber can contain a beverage component or precursor (e.g., espresso coffee grounds) during use of the cartridge in the beverage production machine.

In the above mentioned cartridge aspects, the first end can be an open end. The open end can be covered by a filter element adapted to allow liquid to pass therethrough or a sheet capable of being pierced or ruptured to allow liquid to pass therethrough. In certain aspects, the first end can include a radially outwardly extending lip to which the filter element or sheet can be joined (e.g., bonded or adhered).

In any of the above mentioned cartridge aspects, the cartridge can include a filter element joined with the second end and capable of allowing passage of liquid therethrough.

In any of the above mentioned cartridge aspects, the cartridge can include a baffle capable of directing a flow of liquid around the baffle and through the filter element (if present) and/or the at least one restricting orifice.

In any of the above mentioned cartridge aspects, the at least one restricting orifice can be a single restricting orifice. The single restricting orifice can be located at the radial center of the second end.

In any of the above mentioned cartridge aspects, the at least one restricting orifice can include a plurality of restricting orifices. In certain aspects, each of the plurality of restricting orifices can be equidistant from the center of the second end. In certain aspects, each of the plurality of restricting orifices can be equidistant from a periphery of the second end. In certain aspects, the plurality of restricting orifices can include a first orifice, a second orifice, and a third orifice. The first orifice can be separated from the second orifice, and the second orifice can be separated by the third orifice, by the same distance.

In any of the above mentioned cartridge aspects, at least one orifice can have a nozzle shape (e.g., a first diameter at one axial location and a second diameter greater than the first diameter at a second axial location different than the first axial location).

Certain aspects of the disclosure are directed toward a method of preparing a single serving of a beverage. The method can include providing a cartridge having a beverage component or precursor as described in any of the cartridge aspects described above; introducing liquid into communication with the beverage component or precursor to form a beverage; and dispensing the beverage through at least one restricting orifice. The restricting orifice can facilitate creation of at least about 9 bar of pressure in the cartridge during operation of the beverage production machine.

In the above mentioned method aspects, the method can include introducing a liquid through a cover coupled with the first end of the cartridge. The cover can be a sheet capable of being punctured or ruptured to permit the passage of liquid therethrough or a filter element adapted to permit the passage of liquid therethrough.

In any of the above mentioned method aspects, the method can include introducing a liquid through a filter element coupled with the second end of the cartridge.

In any of the above mentioned method aspects, the method can include directing a flow of liquid around a baffle and through the at least one restricting orifice.

System Overview

Figure 1B:
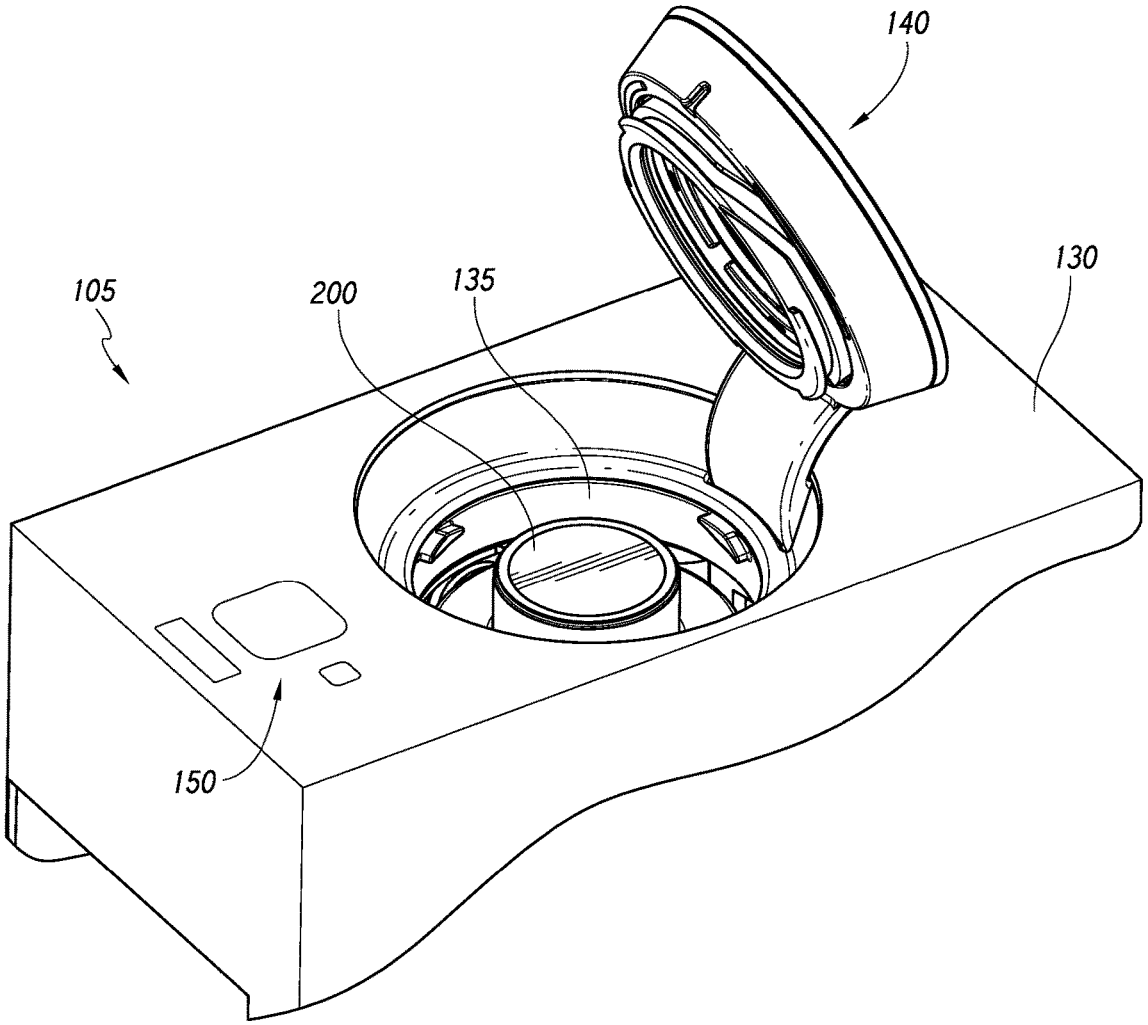
FIG. 1B illustrates a perspective view of an upper portion of the beverage production machine of FIG. 1A, with a lid in an open position and a cartridge received in the brewer.

FIG. 1A illustrates a perspective view of an embodiment of a beverage preparation machine 100 that can dispense a beverage into a cup or other vessel 101. The beverage preparation machine 100 can include a brewer 105. In some embodiments, one or more of the components of the beverage preparation machine 100 are housed on and/or partially in a tray 120. As shown in FIG. 1B, an upper portion of the brewer 105 can include a top with an opening to facilitate the loading of a single-serving beverage cartridge 200 (e.g., a single-serve cartridge) into the basket assembly 500 (see FIG. 1C).

The beverage preparation machine 100 can include a liquid reservoir within the brewer 105 or external to the brewer 105. For example, the liquid reservoir can be external to the brewer 105 and in fluid communication (e.g., via tubing or pipes) with the brewer 105 to provide liquid (e.g., water) stored within the liquid reservoir to a chamber within the brewer 105 where the beverage is prepared. In various embodiments, the liquid is pre-heated before entering the chamber. For example, the liquid may be heated within a separate storage reservoir or within fluid supply lines as the liquid travels to the chamber. The amount of liquid (e.g., water) provided to the chamber from the liquid reservoir may be determined by the beverage recipe. The liquid reservoir may include a water level sensor that can determine whether enough liquid is present in the liquid reservoir to prepare a requested beverage. In some embodiments, the beverage preparation machine 100 can include a frother unit (not shown) that can froth a liquid (e.g., frothed milk). After dispensing a brewed beverage into the cup 101, the frothed liquid (e.g., frothed milk) can be poured into the beverage. The frother unit may include a control input to toggle the frothing on and off.

Figure 1C:
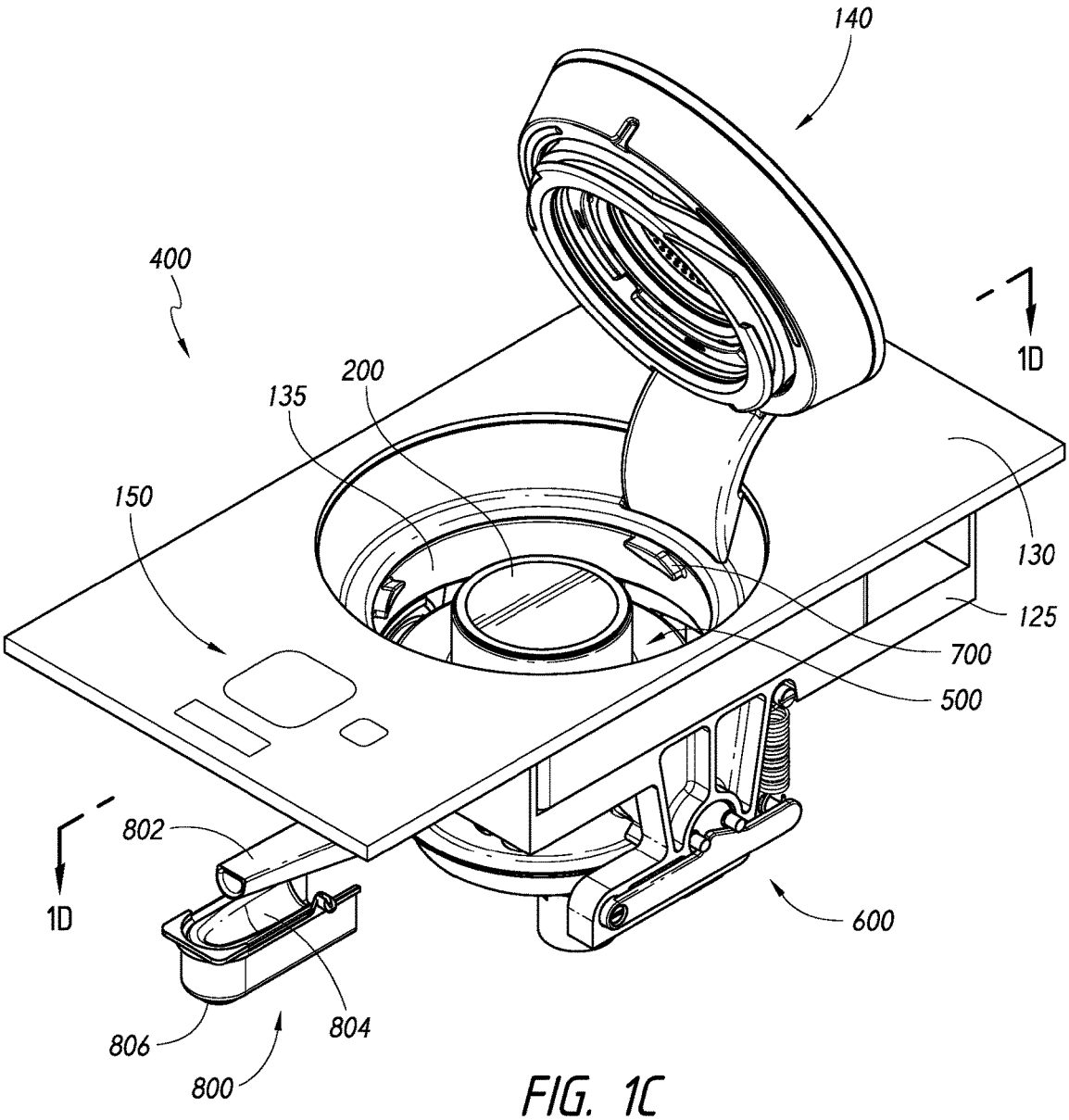
FIG. 1C illustrates a perspective view of the beverage production assembly of FIG. 1B with the housing hidden.
Figure 1D:
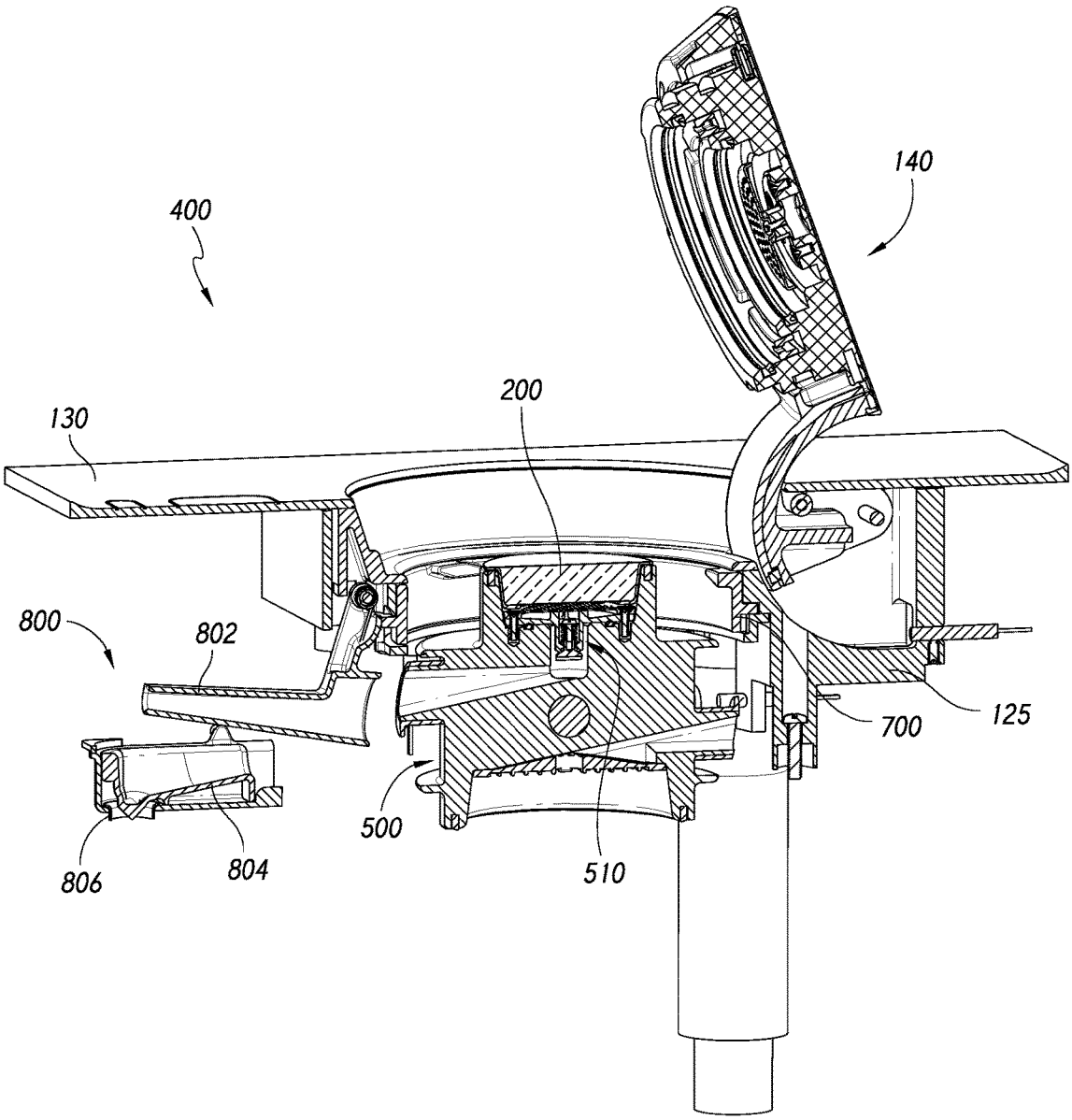
FIG. 1D illustrates a cross-section of the beverage production assembly of FIG. 1C through line 1D-1D.

As shown in FIGS. 1C and 1D, the brewer 105 can include a frame 125 that supports a beverage production assembly 400 having a multi-chambered basket unit 500. As also shown, an upper portion of the brewer 105 can include a top 130 with an opening 135 to facilitate the loading of a single-serve beverage cartridge 200 (e.g., a single-serve cartridge with a porous upper and/or lower surface) into the basket unit 500. The opening 135 can be selectively opened and closed with a lid assembly 140. Additional details regarding single-serve beverage cartridge 200 and the lid assembly 140 are disclosed in U.S. application Ser. No. 14/191,225, titled STRETCHABLE BEVERAGE CARTRIDGES AND METHODS, filed Feb. 26, 2014, which is hereby incorporated by reference, and should be considered a part of this specification.

In various embodiments, the brewer 105 can include an input and output unit 150. For example, the input and output unit 150 can include an indicator (e.g., a light, display, dial, or otherwise) to indicate status information, such as whether the brewer 105 has power, is operating, requires maintenance, etc. The input and output unit 150 can include a user-interface member (e.g., a button or switch) to provide instruction to the brewer 105, such as a command to begin the beverage production process. The input and output unit 150 can be connected with a memory and/or a controller, such as a microprocessor.

In some variants, the input and output unit 150 can include a reader. The reader can read a code (e.g., optical code, bar code, quick response (QR) code, etc.) and/or a tag (e.g., an radio frequency identification (RFID) tag) on the cartridge or associated packaging. This can allow the brewer 105 to identify the type of beverage to be produced. For example, reading a cartridge containing espresso coffee grounds can identify to the brewer 105 that an espresso beverage is to be produced. In several implementations, the beverage production assembly 400 is adjusted based on the type of beverage to be produced, as is discussed in more detail below. Additional details regarding the reader are disclosed in U.S. application Ser. No. 14/205,198, titled "SINGLE-SERVE BEVERAGE PRODUCTION MACHINE," filed on the same day as the present application, the entirety of which is hereby incorporated by reference and should be considered a part of this specification.

In some implementations, when the cartridge 200 has been loaded into the basket unit 500 and the lid assembly 140 has been closed, a beverage preparation process can begin. In some embodiments of the beverage preparation process, liquid (e.g., hot water) is introduced into the cartridge 200 to produce a beverage. The beverage can exit the cartridge 200 and be conveyed through portions of the brewer 105 to the cup 101. For example, the beverage can be conveyed through a dispensing assembly 800. In some embodiments the dispensing assembly 800 includes a pivoting member 802, a catch member 804, and a dispensing nozzle 806.

As noted above and shown in FIGS. 1C and 1D, the beverage production assembly 400 can include the multi-chambered basket unit 500. The beverage production assembly 400 can also include a ratchet assembly 600 and a collar 700. Engagement between the ratchet assembly 600 and the collar 700 can facilitate movement (e.g., rotation) of the basket unit 500. The basket unit 500 can selectively positioned to provide access to a desired chamber in the basket, such as for loading a cartridge. Additional details regarding the basket unit 500 are disclosed in U.S. application Ser. No. 14/205,256, titled "BEVERAGE PRODUCTION MACHINES AND METHODS WITH MULTI-CHAMBERED BASKET UNITS," filed on the same day as the present application, the entirety of which is hereby incorporated by reference and should be considered a part of this specification.

In some embodiments, a tamping mechanism (e.g., in the lid assembly 140) depresses the cartridge 200 positioned in the basket unit 500. Additional details regarding the tamping mechanism can be found in U.S. application Ser. No. 14/205,241, titled "BEVERAGE PRODUCTION MACHINES AND METHODS WITH TAMPING ASSEMBLY," filed on the same day as the present application, the entirety of which is hereby incorporated by reference.

In some embodiments, a restriction assembly 510 can be positioned in the basket unit 500 (see FIG. 1D). The restriction assembly 510 can be configured to facilitate an increase in pressure in one or more of the chambers of the basket unit 500 during the beverage production process. Additional details regarding restriction assemblies can be found in U.S. application Ser. No. 14/205,232, titled "BEVERAGE PRODUCTION MACHINES AND METHODS WITH RESTRICTORS," filed on the same day as the present application, the entirety of which is hereby incorporated by reference and should be considered a part of this specification.

In some embodiments, rotation of the basket unit 500 can aid in ejecting or otherwise removing a used or unwanted cartridge 200 from the basket unit 500. More details about cartridge ejection mechanisms and features can be found in U.S. application Ser. No. 14/205,261, titled "CARTRIDGE EJECTION SYSTEMS AND METHODS FOR SINGLE-SERVE BEVERAGE PRODUCTION MACHINES," filed on the same day as the present application, the entirety of which is hereby incorporated by reference.

Single Orifice Pod

FIGS. 2A-2D illustrate an embodiment of a cartridge 200. The term "cartridge" as used herein shall be given its ordinary and customary meaning, and shall include, without limitation, cartridges, capsules, cups, pods, and the like. Certain embodiments of the cartridge 200 can be used in a single-serve beverage machine, such as the beverage preparation machine 100.

Figure 2A:
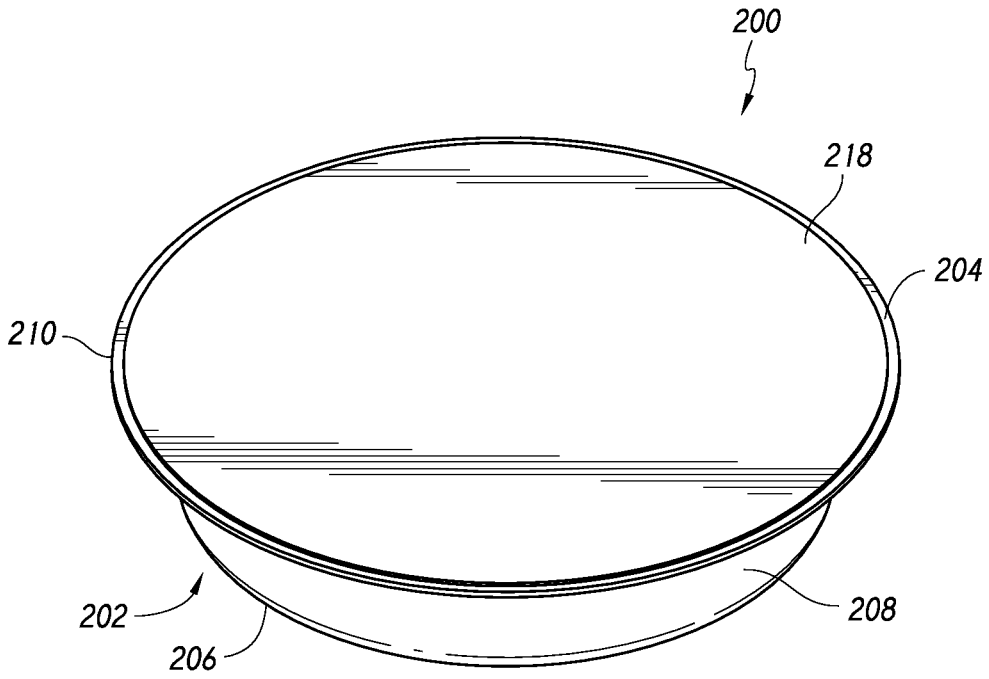
FIG. 2A illustrates a top perspective view of an embodiment of a cartridge that can be used with the beverage production machine shown in FIG. 1A.

As shown in FIG. 2A, the cartridge 200 can include a body portion 202 having a sidewall 208, a first end 204, and a second end 206. The first end 204 can be an open end coupled with (e.g., generally covered or closed by) a cover 218. The cover 218 can be a filter having voids or openings therein or a sheet capable of being pierced to form one or more openings. The second end 206 can be a closed end including a bottom wall of the cartridge 200. As such, the body portion 202, the cover 218, and the second end 206 can define a generally closed chamber 212 in the cartridge 200. In various embodiments, the chamber 212 can include a beverage component or precursor (e.g., ground coffee). Some variants of the body portion 202 have a gradually tapered or generally cylindrical shape (e.g., tapered or cylindrical side wall 208). However, other shapes can be used without departing from the spirit and/or scope of the disclosure. In certain embodiments, the covered first end 204 and the second end 206 can both be generally planar (e.g., flat). In certain variants, at least one of the covered first end 204 and the second end 206 can define a curved surface.

In some embodiments, the cover 218 can connect with an outer surface of the body portion 202. For example, as shown in FIG. 2A, the first end 204 can include a radially-outwardly extending shoulder, lip, or flange 210 to which the cover 218 can be joined with (e.g., bonded or adhered). In some embodiments, the cover 218 can connect with an inside surface of the body portion 202.

Figure 2B:
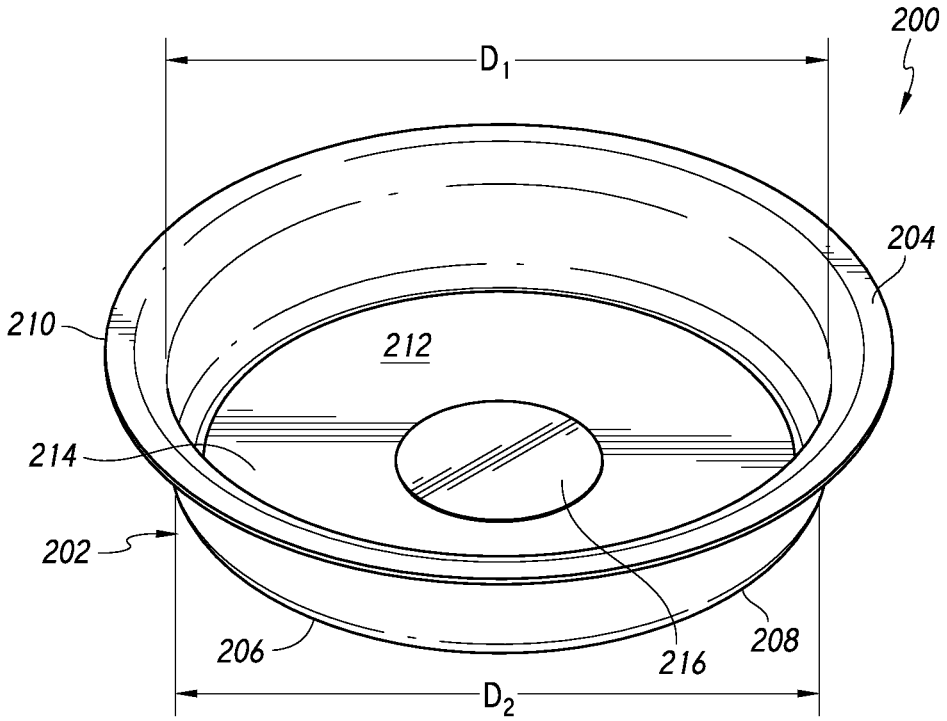
FIG. 2B illustrates a top perspective view of the embodiment of the cartridge shown in FIG. 2A without the cover.

In some embodiments, as shown in FIG. 2B, a filter element 214 can connect with the second end 206 and/or sidewall 208. The filter element 214 can inhibit passage of the beverage component or precursor and permit the passage of the beverage. For example, as shown in FIG. 2B, the filter element 214 can have a diameter that is substantially the same as the inner diameter of the second end, such that the filter element 214 covers substantially the entire inner bottom wall of the cartridge 200. The filter element 214 can include voids or openings that can inhibit (e.g., by the size, shape, and/or location of the voids or openings) passage of the beverage component or precursor yet allow the passage of the liquid.

In some embodiments, the first end 204 has a diameter D1 (see FIG. 2B). Certain implementations have diameter D1 of greater than or equal to about 10 mm and/or less than or equal to about 100 mm, for example, between about 20 mm and about 80 mm. Some embodiments have a diameter D1 between about 40 mm and about 70 mm, such as about: 40 mm, 45 mm, 50 mm, 55 mm, 60 mm, 65 mm, 70 mm, or values between the aforementioned values. Certain variants have a diameter D1 of greater than or equal to about 40 mm and/or less than or equal to about 65 mm.

In some embodiments, the second end 206 has a diameter D2 (see FIG. 2B). Certain implementations have a diameter D2 of greater than or equal to about 10 mm and/or less than or equal to about 100 mm, for example, between about 20 mm and about 80 mm. Some embodiments have a diameter D2 between about 30 mm and about 70 mm, such as about: 30 mm, 35 mm, 40 mm, 45 mm, 50 mm, 55 mm, 60 mm, or values between the aforementioned values. Certain variants have a diameter D2 of greater than or equal to about 30 mm and/or less than or equal to about 50 mm.

Figure 2C:
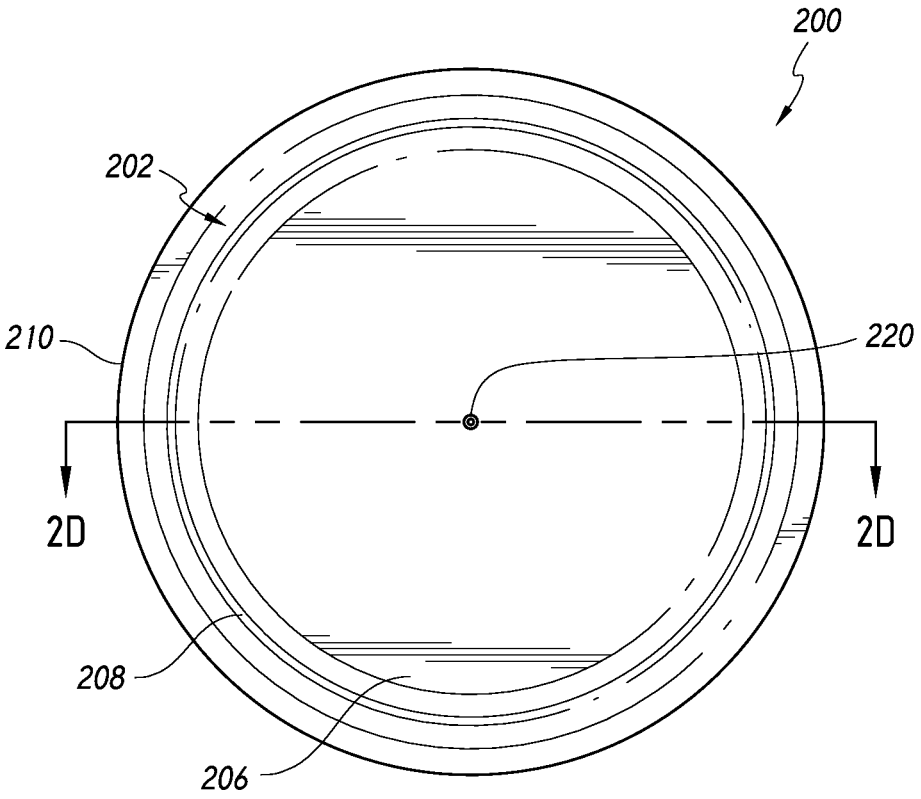
FIG. 2C illustrates a bottom view of the embodiment of the cartridge shown in FIG. 2B.
Figure 2D:
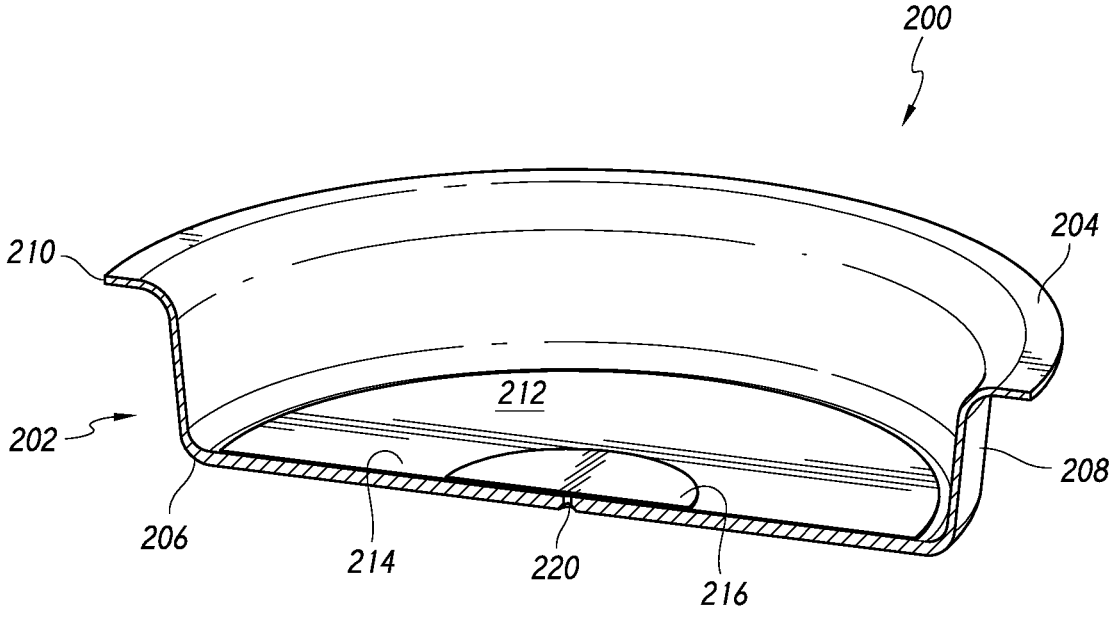
FIG. 2D illustrates a cross-section of the embodiment of the cartridge shown in FIG. 2C taken along line 2D-2D.

In some embodiments, as shown in FIGS. 2C and 2D, the second end 206 can include a single restricting orifice 220.

The restricting orifice 220 and/or filter element 214 can restrict, hamper, or otherwise limit the discharge of liquid through the second end 206 of the cartridge 200. Limiting the discharge of liquid from the cartridge 200 can facilitate creating a pressure increase inside the cartridge 200, which can aid in the production of certain beverages (e.g., espresso) and/or can aid in compensating for certain inconsistencies in the beverage component or precursor (e.g., due to variations in the grind, tamping, settling or disruption during shipping, or otherwise). Some implementations of the restricting orifice 220 can provide, and/or to facilitate the creation of, at least about 6 bar and/or less than or equal to about 12 bar of pressure in the cartridge 200, preferably about 9 bar during operation of the beverage production machine.

The restricting orifice 220 can achieve the desired pressure in less than or equal to about 25 seconds following delivery of liquid into the cartridge 200, often less than or equal to about 10 seconds, such as less than or equal to about 8 seconds or less than or equal to about 5 seconds, preferably less than or equal to about one second. Further, the percentage of total dissolved solids (e.g., an indicator of coffee strength) can be less than about 5.0%, such as between about 4.5% and about 5.0%. In some embodiments, the percentage of total dissolved solids can be greater than about 5.0%.

As illustrated in FIGS. 2C and 2D, the restricting orifice 220 can be substantially smaller (e.g., in diameter) than the first end 204 and/or the second end 206. For example, the ratio of the diameter of the restricting orifice 220 compared to the diameter of the second end 206 can be between about 1:220 and 1:5, such as no more than about: 1:5, 1:10, 1:15, 1:20, 1:25, 1:30, 1:40, 1:50, 1:60, 1:100, 1:120, 1:140, 1:160, 1:180, or 1:200 and/or at least about 1:220. The restricting orifice 220 can have a diameter of at least about 0.005 inches and less than or equal to about 0.03 inches, for example, about 0.008 inches, about 0.012 inches, about 0.014 inches, about 0.016 inches, about 0.018 inches, about 0.02 inches, about 0.022 inches, about 0.024 inches, about 0.026 inches, about 0.028 inches, or values between the aforementioned values.

As shown, some implementations include a single restricting orifice 220. According to some embodiments, the restricting orifice 220 can be positioned in the generally radial center of the cartridge 200 (e.g., at the radial center of the second end 206). In certain embodiments, the restricting orifice 220 can be positioned off-center. In some embodiments, the restricting orifice 220 can be generally conical or nozzle-shaped. In certain such variants, a reduced-size portion (e.g., the throat) of the generally conical or nozzle-shaped restricting orifice 220 can generally abut the filter element 214. As shown in FIG. 2D, the restricting orifice 220 can be aligned with (e.g., extend about) a longitudinal axis of the cartridge 200; however, in other implementations, the restricting orifice 220 can be positioned at an angle relative to the longitudinal axis.

Figure 2E:
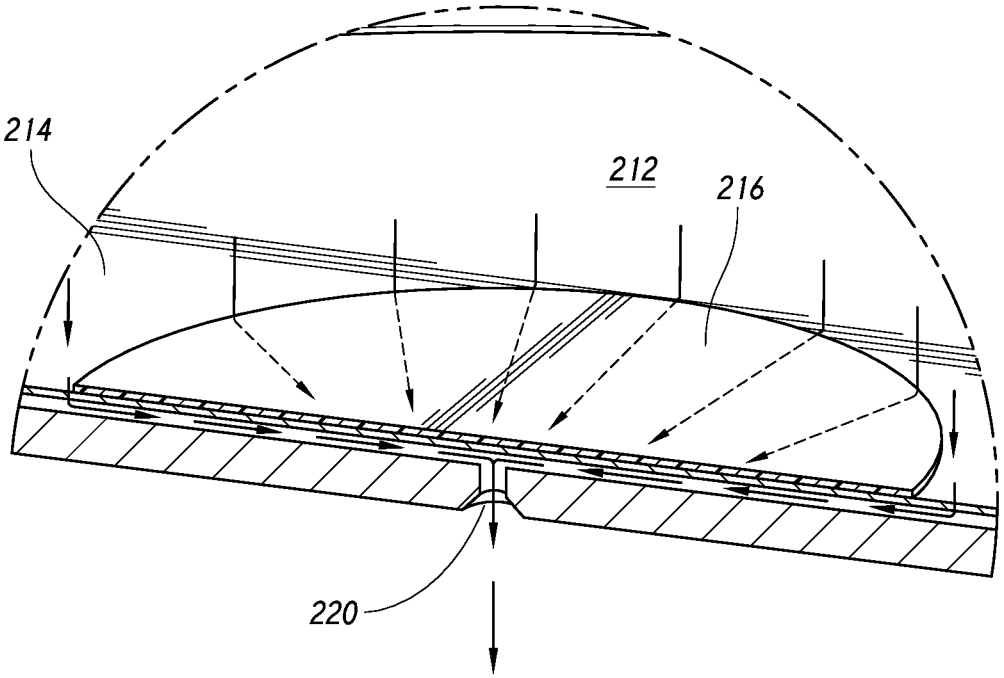
FIG. 2E illustrates a detailed view of a bottom portion of the cartridge shown in FIG. 2D and the fluid flow pathway through the bottom portion.

As shown in FIG. 2B, some embodiments of the cartridge 200 can include a baffle 216, such as a disk of metal foil, plastic (e.g., delrin), or otherwise. The baffle 216 can include a thickness of less than or equal to about 0.01 inches, for example, about 0.005 inches. The baffle 216 can restrict or divert the flow of liquid discharged through the filter element 214 (if present) and/or through the restricting orifice 220, such as after the liquid has mixed with the beverage component or precursor inside the cartridge 200 to produce an extracted beverage. The baffle 216 can be secured to the filter element 214 or the second end 206 if the filter element 214 is not present. In some implementations the baffle 216 can be made of a generally liquid impermeable material and includes perforations, holes, grooves, channels, or otherwise to permit the liquid to flow therethrough. In some variants, the baffle 216 can direct the extracted beverage to flow around the baffle 216. For example, the baffle 216 can encourage the extracted beverage to flow generally around the sides of the baffle 216 and/or under the baffle 216. In some embodiments, the flow can be forced to go around the baffle 216 and travel generally horizontally through the filter element 214 to reach the restricting orifice 220 (see FIG. 2E).

In some implementations, the baffle 216 can inhibit localized flow vortices and/or facilitate a pressure increase in the cartridge 200. For example, the baffle 216 can facilitate the creation of at least about 9 bar of pressure in the cartridge 200 during use, which can be beneficial in the production of some beverages, such as espresso. In some implementations, the baffle 216 can facilitate the creation of less than or equal to about 5 psi of pressure in the cartridge 200, such as during the production of brewed coffee. In some embodiments, the baffle 216 can be generally held in position (e.g., on or relative to the filter element 214) by teeth or serrations at the edge, by adhesive, or otherwise. In certain variants, the baffle 216 can be thinner than the filter element 214.

Multiple Orifice Pod

With reference to FIGS. 3A-3D, another illustrative embodiment of a single serve beverage cartridge 300 is shown. The cartridge 300 resembles or is identical to the cartridge 200 discussed above in many respects. Accordingly, numerals used to identify features of the cartridge 300 are incremented by one hundred (100) to identify like features of the cartridge 300. This numbering convention generally applies to the remainder of the figures. Any component or step disclosed in any embodiment in this specification can be used in other embodiments.

Figure 3A:
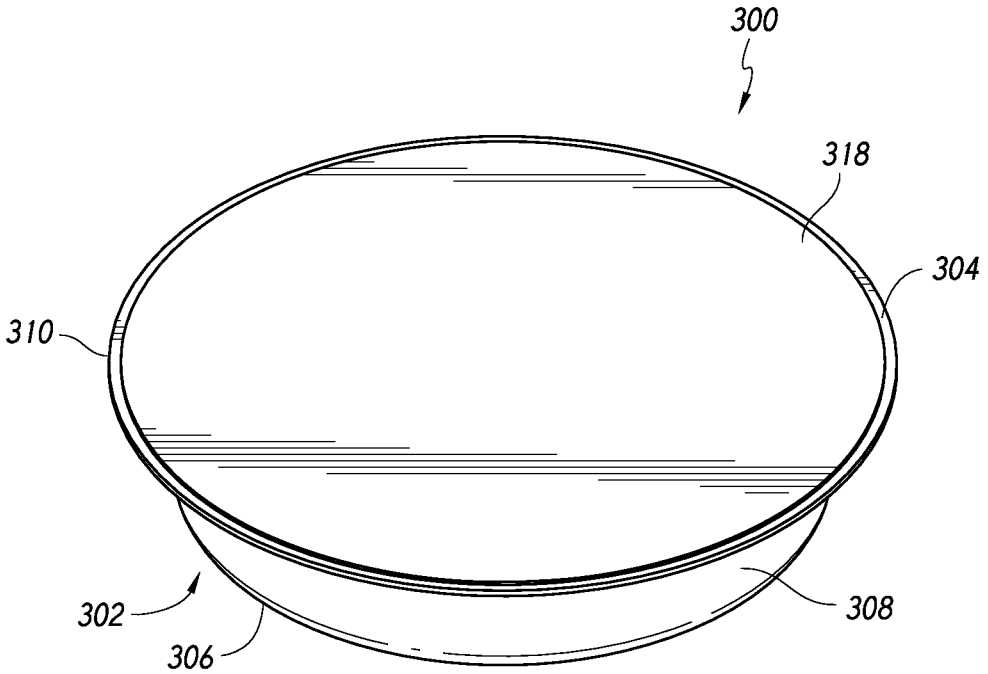
FIG. 3A illustrates a top perspective view of another embodiment of a cartridge that can be used with the beverage production machine shown in FIG. 1A.
Figure 3B:
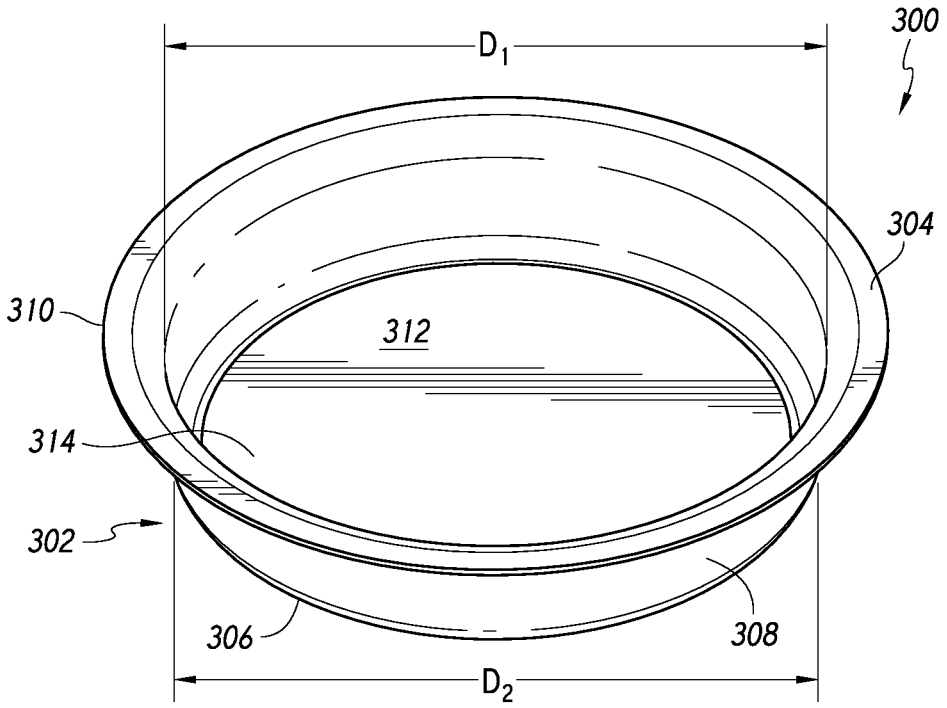
FIG. 3B illustrates a top perspective view of the embodiment of the cartridge shown in FIG. 3A without the cover.

As shown in FIG. 3A, the cartridge 300 can include a body portion 302 having a sidewall 308, a first end 304, and a second end 306. The first end 304 can be an open end coupled with (e.g., generally covered or closed by) a cover 318. The cover 318 can be a filter having voids or openings or a sheet capable of being pierced to form one or more openings. The second end 306 can be a closed end including a bottom wall of the cartridge 300. As such, the body portion 302, the cover 318, and the second end 306 can define a generally closed chamber 312 in the cartridge 300. In various embodiments, the chamber 312 can include a beverage component or precursor (e.g., ground coffee). Some variants of the body portion 302 have a gradually tapered or generally cylindrical shape (e.g., tapered or cylindrical side wall 308). However, other shapes can be used without departing from the spirit and/or scope of the disclosure. In certain embodiments, the covered first end 304 and the second end 306 can both be generally planar (e.g., flat). In certain variants, at least one of the covered first end 304 and the second end 306 can define a curved surface.

Although not shown, similar to the cartridge 200, some embodiments of the cartridge 300 include one or more baffles, such as a disk of metal foil, plastic (e.g., delrin), or otherwise. The baffle can include a thickness of less than or equal to about 0.01 inches, for example, about 0.005 inches. The baffle can restrict or divert the flow of liquid discharged through the filter element 314 (if present) and at least one restricting orifice 320, such as after the liquid has mixed with the beverage component or precursor inside the cartridge 300 to produce an extracted beverage. The baffle 316 can be secured to the filter element 314 or the second end 306 if the filter element 314 is not present. In some implementations the baffle can be made of a generally liquid impermeable material and includes perforations, holes, grooves, channels, or otherwise to permit the liquid to flow therethrough. In some variants, the baffle can direct the extracted beverage to flow around the baffle. For example, the baffle can encourage the extracted beverage to flow generally around the sides of the baffle and/or under the baffle. In some embodiments, the flow is forced to go around the baffle and travel generally horizontally through the filter element.

Figure 3C:
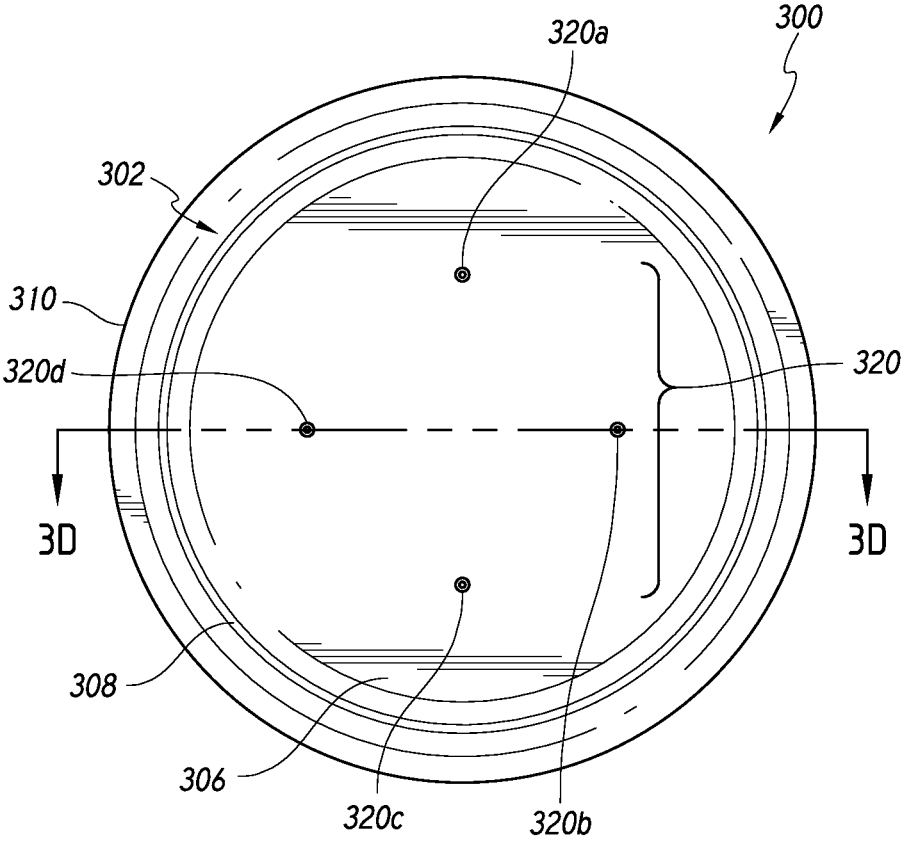
FIG. 3C illustrates a bottom view of the embodiment of the cartridge shown in FIG. 3B.
Figure 3D:
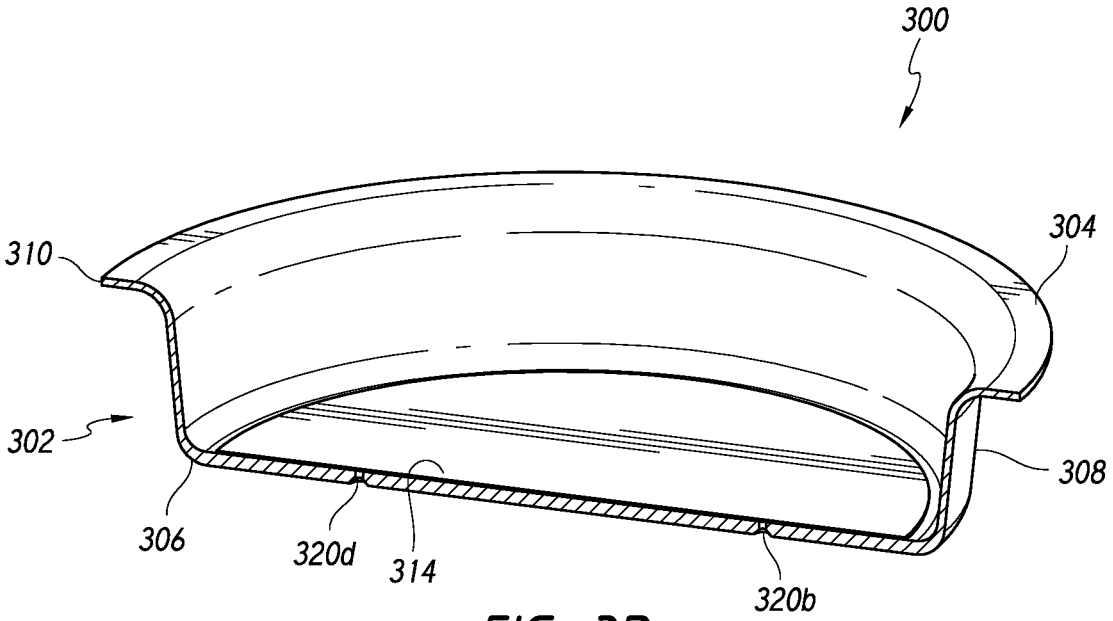
FIG. 3D illustrates a cross-section of the embodiment of the cartridge shown in FIG. 3C taken along line 3D-3D.

In some embodiments, as shown in FIGS. 3C and 3D, the second end 306 can include a plurality of restricting orifices 320. The restricting orifices 320 and/or filter element 314 can restrict, hamper, or otherwise limit the discharge of liquid through the second end 306 of the cartridge 300. In some embodiments, limiting the discharge of liquid from the cartridge 300 can facilitate creating a pressure increase inside the cartridge 300, which can aid in the production of certain beverages (e.g., espresso) and/or can aid in compensating for certain inconsistencies in the beverage component or precursor (e.g., due to variations in the grind, tamping, settling or disruption during shipping, or otherwise). Some implementations of the restricting orifice 320 can provide, and/or to facilitate the creation of at least about 6 bar and/or less than or equal to about 12 bar, preferably about 9 bar of pressure in the cartridge 300 during operation of the beverage production machine. The restricting orifices 320 can achieve the desired pressure in less than or equal to about 25 seconds, often less than or equal to about 10 seconds, such as less than or equal to about 8 seconds or less than or equal to about 5 seconds. Further, the percentage of total dissolved solids can be less than about 5.0%, such as between about 4.0% and about 5.0%.

As illustrated in FIGS. 3C and 3D, the restricting orifices 320 can be substantially smaller (e.g., in diameter) than the first end 304 and/or the second end 306. For example, the ratio of the diameter of one of the restricting orifices 320 compared to the diameter of the second end 306 can be at least about: 1:5, 1:10, 1:15, 1:20, 1:25, 1:30, 1:40, 1:50, 1:60, 1:100, 1:120, 1:140, 1:160, 1:180, 1:200, 1:250, 1:300, 1:400, 1:500, 1:600, 1:700, 1:800 ratios between the aforementioned ratios, or otherwise. The restricting orifice 320 can have a diameter of at least about 0.005 inches and less than or equal to about 0.03 inches, for example, about 0.009 inches, about 0.01 inches, about 0.012 inches, about 0.014 inches, about 0.016 inches, about 0.018 inches, about 0.02 inches, about 0.022 inches, about 0.024 inches, about 0.026 inches, about 0.028 inches, or values between the aforementioned values.

In some embodiments, the restricting orifices 320 are generally conical or nozzle-shaped. In certain such variants, a reduced-size portion (e.g., the throat) of the generally conical or nozzle-shaped restricting orifice 320 can generally abut the filter element 314. As shown in FIG. 3D, each restricting orifice 320 can be generally parallel with a longitudinal axis of the cartridge 300; however, in other implementations, each restricting orifice 320 can be positioned at an angle relative to the longitudinal axis, such as at least about 1 degree and/or less than about 90 degrees either toward a sidewall 308 or toward a center of the chamber 312. For example, the angle can be between about 1 degree and 15 degrees (e.g., about 1 degree, about 3 degrees, about 5 degrees, about 7 degrees, or about 10 degrees), between about 15 degrees and 30 degrees, between about 30 degrees and about 45 degrees, between about 45 degrees and about 60 degrees, between about 60 degrees and about 75 degrees, or between about 75 degrees and about 90 degrees.

As shown in FIG. 3C, the plurality of restricting orifices 320 can include four restricting orifices 320*a*, 320*b*, 320*c*, 320*d* (collectively referred to as restricting orifices 320). Although FIG. 3C illustrates four restricting orifices 320, two, three, five, six, or more restricting orifices may be desirable depending on the size of the cartridge, type of beverage precursor, and/or recipe parameters.

The restricting orifices 320 can be positioned in a configuration that is generally symmetrical to evenly distribute the pressure contained within the chamber 312. For example, as shown in FIG. 3C, the restricting orifices 320 can be evenly spaced around a circular configuration. The circular configuration can have a diameter of at least about 25 mm and/or less than or equal to about 35 mm, such as about 26 mm, about 28 mm, about 30 mm, about 32 mm, or about 34 mm. If the cartridge 300 includes more than four restricting orifices 320, the restricting orifices 320 can form one or more symmetrical, circular configurations. Although not shown, if the cartridge 300 includes at least two circular configurations, the circles can be concentric. In some embodiments, the cartridge 300 can also include a centrally-disposed restricting orifice 320 (e.g., at the radial center of the second end 306).

In some embodiments, each of the restricting orifices 320 can be positioned equidistant from the center of the second end 306. As shown in FIG. 3C, in some implementations, each of the restricting orifices 320 can be positioned at a distance from the center of the second end 306 that is at least about 50% of the radius of the second end 306, for example, about 55%, 60%, 65%, 70%, 75%, percentages between the aforementioned percentages, or otherwise. Although, in other implementations, the distance between each of the restricting orifices 320 and the center of the second end 306 can be less than about 50% of the radius of the second end 306, for example, about 25%, 30%, 35%, 40%, 45%, percentages between the aforementioned percentages, or otherwise.

In some embodiments, each of the restricting orifices 320 can be positioned equidistant from a periphery of the second end 206. As shown in FIG. 3C, in some implementations, the distance between each of the restricting orifices 320 and the periphery of the second end 306 can be less than about 50% of the radius of the second end 306, for example, about 25%, 30%, 35%, 40%, 45%, percentages between the aforementioned percentages, or otherwise. Although, in other implementations, each of the restricting orifices 320 can be positioned at a distance from the center of the second end 306 that is at least about 50% of the radius of the second end 306, for example, about 55%, 60%, 65%, 70%, 75%, percentages between the aforementioned percentages, or otherwise.

In some embodiments, each of the restricting orifices 320 can be positioned equidistant from each other. For example, a first orifice 320*a* can be separated from a second orifice 320*b* by a first distance and a second orifice 320*b* can be separated from a third orifice by a second distance. The first distance can be substantially equal to the second distance.

Method of Use

In use, the cover 218 can permit the introduction of liquid, such as water or milk, into the cartridge 200. As explained above, the cover 218 can be a filter element adapted to permit the passage of liquid therethrough or a sheet capable of being punctured or ruptured to permit the passage of liquid therethrough. The liquid can be introduced into the beverage component or precursor to form a beverage. The beverage can be discharged from the cartridge 200 via at least the filter element 214 and/or restricting orifice 220. In some embodiments, the flow of liquid can be restricted or diverted around a baffle 216, such as after the liquid has mixed with the beverage component or precursor inside the cartridge 200 to produce an extracted beverage. In some embodiments, at least one of the cover 218 and the filter element 214 can allow passage of liquid under pressure, such as at least about: 0.25 bar, 0.5 bar, 1 bar, 2 bar, 3 bar, 4 bar, 6 bar, 7, bar, 8 bar, 9 bar, 10 bar, 12 bar, values between the aforementioned values, and otherwise, during operation of the beverage production machine. In some embodiments, the restricting orifice 220 can allow passage of liquid under pressure, such as at least about 9 bar, 10 bar, 11 bar, 12 bar, values between the aforementioned values, and otherwise.

Some implementations of the cartridge 200, and/or of a single-serve beverage machine capable of accepting the cartridge 200, include additional or other pressure facilitating features. For example, some embodiments of the cartridge 200 include a valve (e.g., a flap or duckbill valve) that can be opened, closed, or modulated to generate pressure in the cartridge 200. In some embodiments, a valve that is part of the single-serve beverage machine, and is positioned downstream from the cartridge 200, can generate the pressure in the cartridge 200. Certain embodiments of the valve can be actively adjusted, such as based on liquid flow rate, pressure in the cartridge or brew system, or otherwise. Some variants of the valve can include a spring-loaded valve that opens and closes, or adjusts, as the pressure in the cartridge increases and decreases. In various embodiments, the valve can be opened for cleaning, rinsing, flushing, and/or to increase the flow rate out of the cartridge 200 and/or through the single-serve beverage machine.

Although the method of use is described with reference to the cartridge 200, the same method can be employed by the cartridge 300.

Method of Manufacturing

Various methods of forming the cartridge 200 are contemplated. For example, in some embodiments, at least the body portion 202 of the cartridge 202 can be formed by a molding process, such as injection molding. In some variants, the body portion 202 is formed by thermoforming or otherwise. In various embodiments, the restricting orifice 220 can be readily made in the cartridge 200, such as during a molding operation or with a punch.

In some embodiments, at least one of the cover 218 and filter element 214 can be joined with the body portion 202 in the mold. In certain embodiments, some of the body portion 202 flows (e.g., while in a heated state) through a portion of the at least one of the cover 218 and filter element 214. In some variants, the cover 218 and/or filter element 214 is joined with the body portion 202 by adhesive, compression (e.g., pinching, crimping, or the like), UV-curing, thermal or sonic welding, or otherwise.

In various embodiments, at least a portion of the cartridge 200 is formed of a biodegradable and/or compostable material. The term "biodegradable" as used herein shall be given its ordinary and customary meaning, and shall include, without limitation, substances and objects that are capable of being decomposed or otherwise broken-down into innocuous products by the action of living things, such as bacteria, within a reasonable period of time. The term "compostable" as used herein shall be given its ordinary and customary meaning, and shall include, without limitation, substances and objects that can biodegrade in a compost site (e.g., an aerobic composting facility). Articles that are compostable can be biodegradable, and articles that are biodegradable can be compostable. In certain implementations, at least one of the body portion 210, the cover 218, and the filter element 214 is made of a biopolymer, such as polylactic acid (PLA), polyglyconic acid, zein, and poly-3-hydroxybutyrate. Some embodiments comprise CD50122M (commercially available from Ahlstrom Corporation of Helsinki, Finland) and/or DaniMer 15120 (commercially available from DaniMer Scientific, LLC of Bainbridge, Ga., U.S.A.). In certain implementations, at least one of the body portion 202, the cover 218, and the filter element 214 is made of cellulose. In some embodiments, the body portion 202 is made of a molded fiber, such as paper pulp. Some variants of the cover 218 and/or the filter element 214 are made of filter paper. In certain implementations, at least one of the cover 218 and the filter element 214 has a sealing layer of PLA. In certain implementations, substantially the entire cartridge 200 is constructed of PLA. In some variants, the body portion 202 includes a laminate layer (e.g., for sealing). Certain embodiments include recycled and/or reclaimed material, such as post-consumer recycled paper products. Some embodiments can comply with certain compostability standards, such as ASTM6400 and/or EN3432.

Although the method of manufacturing is described with reference to the cartridge 200, the same method can be employed by the cartridge 300.

Although certain embodiments have been described herein with respect to coffee, the cartridges described herein can include particulate materials or components for producing many other types of beverages, such as a chocolate based product (e.g., hot cocoa), tea, juice, and other beverages. Further, although some embodiments have been disclosed in which liquid is introduced into the cartridge, the introduction of other phases is contemplated. For example, in some embodiments, steam or a combination of steam and liquid water is introduced into the cartridge. Additionally, although certain embodiments have been disclosed that include a single beverage component or precursor, the term "beverage component or precursor" is not limited to only a single component. Rather, the beverage component or precursor can comprise one component (e.g., coffee) or a plurality of components (e.g., coffee and a sweetener).

Although this disclosure describes certain embodiments and examples of cartridges, it will be understood by those skilled in the art that many aspects of the methods and devices shown and described in the present disclosure may be differently combined and/or modified to form still further embodiments or acceptable examples. All such modifications and variations are intended to be included herein within the scope of this disclosure. Indeed, a wide variety of designs and approaches are possible and are within the scope of this disclosure. No feature, structure, or step disclosed herein is essential or indispensible. Moreover, while illustrative embodiments have been described herein, the scope of any and all embodiments having equivalent elements, modifications, omissions, combinations (e.g., of aspects across various embodiments), adaptations and/or alterations as would be appreciated by those in the art based on the present disclosure.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The language of the claims is to be interpreted broadly based on the language employed in the claims and not limited to the examples described in the present specification or during the prosecution of the application, which examples are to be construed as non-exclusive.

Some embodiments have been described in connection with the accompanying drawings. However, the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

In summary, various illustrative embodiments and examples of brewers and basket assemblies have been disclosed. Although the brewers and basket assemblies have been disclosed in the context of those embodiments and examples, it will be understood by those skilled in the art that this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow as well as their full scope of equivalents.

The following is claimed:

1. A single-serve beverage cartridge comprising:

a generally hollow body portion comprising a chamber defined by a sidewall, a first end, and a second end, the second end comprising a bottommost wall of the generally hollow body portion and at least one restricting orifice in the bottommost wall, the entire bottommost wall defined by a flat inner surface and a flat exterior surface extending along a single plane, each of the at least one restricting orifice comprises an inlet at the flat inner surface and an outlet at the flat exterior surface, the flat exterior surface forming a bottommost surface of the cartridge;

a beverage component or precursor disposed in the chamber;

a filter element within the chamber and joined to the flat inner surface of the bottommost wall, wherein the filter element is proximal to and spaced apart from the second end to form a flowpath in a gap between the filter element and the flat inner surface, the filter configured to allow liquid to pass therethrough, and a baffle within the chamber and adjacent to the filter element such that the filter element is interposed between the baffle and the bottommost wall, the baffle configured to direct a flow of liquid around the baffle and through the filter element, wherein the at least one restricting orifice is positioned such that, in use, the flow of liquid travels generally horizontally through the flowpath to reach the at least one restriction orifice under the baffle, and wherein prior to brewing a beverage, the chamber is unobstructed between the first end and the beverage component or precursor.

2. The cartridge of claim 1, wherein the first end is an open end.

3. The cartridge of claim 2, further comprising a cover that covers the first end.

4. The cartridge of claim 1, wherein the first end comprises a radially outwardly extending lip.

5. The cartridge of claim 1, wherein the baffle is coupled to the filter element.

6. The cartridge of claim 1, wherein the at least one restricting orifice comprises a single restricting orifice.

7. The cartridge of claim 6, wherein the single restricting orifice is located at the center of the second end.

8. The cartridge of claim 1, wherein the at least one restricting orifice comprises a plurality of restricting orifices.

9. The cartridge of claim 8, wherein each of the plurality of restricting orifices is equidistant from the center of the second end.

10. The cartridge of claim 8, wherein each of the plurality of restricting orifices is equidistant from a periphery of the second end.

11. The cartridge of claim 8, wherein the plurality of restricting orifices comprises a first orifice, a second orifice, and a third orifice, the first orifice separated from the second orifice by a first distance, the second orifice separated by the third orifice by a second distance, the first distance being the same as the second distance.

12. The cartridge of claim 1, wherein the at least one orifice has nozzle shape with a first diameter and a second diameter, the first diameter being smaller than the second diameter.

13. The cartridge of claim 12, wherein the first diameter is closer to the filter element than the second diameter.

14. The cartridge of claim 1, wherein the beverage component or precursor comprises espresso coffee grounds.

15. A method of preparing a single serving of a beverage, the method comprising:

providing a cartridge for insertion into a single-serve beverage machine, the cartridge comprising:

a generally hollow body portion comprising a chamber defined by a sidewall, a first end, and a second end, the second end comprising a bottommost wall of the generally hollow body portion and at least one restricting orifice in the bottommost wall, the entire bottommost wall defined by a flat inner surface and a flat exterior surface extending along a single plane, each of the at least one restricting orifice comprises an inlet at the flat inner surface and an outlet at the flat exterior surface, the flat exterior surface forming a bottommost surface of the cartridge;

a beverage component or precursor positioned in the chamber;

a filter element within the chamber and joined to the flat inner surface of the bottommost wall, wherein the filter element is proximal to and spaced apart from the second end to form a flowpath in a gap between the filter element and the flat inner surface, the filter configured to allow liquid to pass therethrough, and a baffle within the chamber and adjacent to the filter element such that the filter element is interposed between the baffle and the bottommost wall, the baffle configured to direct a flow of liquid around the baffle and through the filter element, wherein the at least one restricting orifice is positioned such that, in use, the flow of liquid travels generally horizontally through the flowpath to reach the at least one restriction orifice under the baffle, and wherein prior to brewing a beverage, the chamber is unobstructed between the first end and the beverage component or precursor;

introducing liquid into communication with the beverage component or precursor to form a beverage; and dispensing the beverage through the restricting orifice, wherein the restricting orifice increases a pressure in the chamber during dispensing of the beverage.

16. The method of claim 15, further comprising introducing the liquid through a cover coupled with the first end of the body portion.

17. The method of claim 15, wherein the pressure in the chamber is at least 9 bar.

18. The cartridge of claim 1, wherein each of the at least one restricting orifice comprises a throat portion extending from the inlet and a conical portion extending from the throat portion to the outlet, the throat portion having a uniform diameter.

19. A single-serve beverage cartridge comprising:

a generally hollow body portion comprising a chamber defined by a sidewall, a first end that defines a top of the cartridge, and a second end that defines a bottom of the cartridge, the second end comprising a bottommost wall of the generally hollow body portion and at least one restricting orifice in the bottommost wall, the entire bottommost wall defined by a flat inner surface and a flat exterior surface extending along a single plane, each of the at least one restricting orifice comprises an inlet at the flat inner surface and an outlet at the flat exterior surface, the flat exterior surface forming a bottommost surface of the cartridge;

the chamber consisting of:

a beverage component or precursor;

a filter element joined to the flat inner surface of the bottommost wall, wherein the filter element is proximal to and spaced apart from the second end to form a flowpath in a gap between the filter element and the flat inner surface, the filter configured to allow liquid to pass therethrough, and a baffle adjacent to the filter element such that the filter element is interposed between the baffle and the bottommost wall, the baffle configured to direct a flow of liquid around the baffle and through the filter element, wherein the at least one restricting orifice is positioned such that, in use, the flow of liquid travels generally horizontally through the flowpath to reach the at least one restriction orifice under the baffle.

* * * * *